US007117553B2

(12) United States Patent
Fairchild et al.

(10) Patent No.: US 7,117,553 B2
(45) Date of Patent: Oct. 10, 2006

(54) APPARATUSES FOR INFANT SUPPORT AND DEVELOPMENT

(76) Inventors: Amy D. Fairchild, 59 Crooked Creek La., Durham, NC (US) 27713; Brenda T. Cunningham, 126 Cabemet Dr., Chapel Hill, NC (US) 27516

( * ) Notice: Subject to any disclaimer, the term of this patent is extended or adjusted under 35 U.S.C. 154(b) by 0 days.

(21) Appl. No.: 11/149,082

(22) Filed: Jun. 9, 2005

(65) Prior Publication Data

US 2005/0278857 A1 Dec. 22, 2005

Related U.S. Application Data

(60) Provisional application No. 60/578,462, filed on Jun. 9, 2004.

(51) Int. Cl.
*A47G 9/00* (2006.01)
*A47D 7/00* (2006.01)

(52) U.S. Cl. ..... 5/655; 5/922; 5/723

(58) Field of Classification Search ..... 5/655, 5/922, 603, 640, 632, 722, 731, 723
See application file for complete search history.

(56) References Cited

U.S. PATENT DOCUMENTS 1,738,411 A 12/1929 Welch
4,528,981 A * 7/1985 Behar ..... 5/637
4,607,403 A 8/1986 Alivizatos
5,165,130 A * 11/1992 Wendling ..... 5/655
5,261,134 A 11/1993 Matthews
5,287,571 A * 2/1994 Rademacher ..... 5/413 R
5,297,304 A * 3/1994 O'Sullivan ..... 5/630
5,310,245 A 5/1994 Lyszczasz
5,367,730 A 11/1994 Sher
5,499,418 A * 3/1996 Tan et al. ..... 5/655
D370,066 S 5/1996 Kennemore
D371,266 S 7/1996 Ward
5,535,467 A * 7/1996 Ciske ..... 5/636
5,546,620 A 8/1996 Matthews
5,632,050 A 5/1997 Zajas et al.
5,675,853 A 10/1997 Linge
5,920,933 A * 7/1999 Chou ..... 5/636
5,937,461 A * 8/1999 Dombrowski et al. ..... 5/655
6,782,572 B1 * 8/2004 Jones ..... 5/640

* cited by examiner

*Primary Examiner*—Alexander Grosz
(74) *Attorney, Agent, or Firm*—Jenkins, Wilson, Taylor & Hunt, P.A.

(57) ABSTRACT

Apparatuses and methods are provided for an infant support apparatus that can be used to support an infant and can permit an infant to develop motor skills and musculature. A support mat in one aspect can have first and second ends and a bolster around which the support mat can be overwrapped to form a head portion. The head portion can be removably attachable to the support mat. The support mat can be adjustably extended and retracted in length to accommodate for infant growth. A foot portion can be positioned opposite the head portion and can be used for engagement by lower extremities of an infant. The head portion can be of any suitable shape, such as for example, the shape of a cylinder, an hourglass, a wedge, or a modified wedge shape.

13 Claims, 26 Drawing Sheets

APPARATUSES FOR INFANT SUPPORT AND DEVELOPMENT

RELATED APPLICATION

This application claims the benefit of U.S. Provisional Patent Application Ser. No. 60/578,462, filed on Jun. 9, 2004, the disclosure of which is incorporated herein by reference in its entirety.

TECHNICAL FIELD

The present subject matter generally relates to infant support and development apparatuses and methods, and more particularly to infant support and development apparatuses and methods able to accommodate infant growth and adapted for developing motor skills and muscular strength, particularly for lower extremities of an infant.

BACKGROUND

The motor skills and muscular development period in the lives of infants is inevitably crucial to their conditioning and musculature growth. This period of growth is considered to be a difficult and potentially hazardous time for infants. The need to properly strengthen muscles and coordinate muscle movement can be assisted with appropriate development and strengthening tools. Current and available mechanisms, however, do not provide leg strengthening configurations adapted to permit infants to kick and push against a resilient structure to develop motor skills and strengthen their lower extremities.

Additionally, pediatricians recommend that infants receive "tummy time" beginning at two months of age. Tummy time refers to placing infants in a prone position on their stomachs. When placed in a prone position, infants develop upper body muscular strength, coordination, and head control. Furthermore, tummy time promotes development of physical skills required for rolling over, sitting, and crawling. Moreover, the prone position aids in minimizing recent concerns of positional plagiocephaly, which is the development of flat surfaces on the head of an infant caused by infants sleeping so many hours on the back of their heads.

Also, while attempting to develop motor skills and muscle strength in their lower extremities, infants will kick and push with their legs as they become older. During this development, parents may place infants on a chair, couch, or other soft surface to stand and develop muscle strength so that when the infant loses his balance and falls there will be a soft landing waiting. This, however, requires constant attention by the parent to ensure the infant does not fall off the couch or chair.

Current infant support pads with dual cushions on opposite ends are merely for maintaining the infant in a stationary position while sleeping or riding in a vehicle. Also, restraining devices are available for maintaining an infant in a stationary position to prevent the infant from rolling, but none function to build motor skills and musculature in an infant. Other structures available simply accommodate resting adults by providing adaptable cushioning for the legs and head to conform to at rest. Moreover, no apparatus is available that permits an infant to develop leg muscles and lower extremities safely while in either a prone or supine position and wherein the apparatus is adjustable to accommodate infant growth.

SUMMARY

Apparatuses and methods are provided in accordance with the present disclosure for an infant support apparatus that can be used to support an infant and can permit an infant to develop motor skills and musculature. In one embodiment, a support mat is provided having first and second ends and a bolster around which the support mat can be overwrapped to form a head portion. The head portion can be removably attachable to the support mat. The support mat can be adjustably extended and retracted in length to accommodate for infant growth. A foot portion can be positioned opposite the head portion and can be used for engagement by lower extremities of an infant. The head portion can be of any suitable shape, such as for example, the shape of a cylinder, an hourglass, a wedge, or a modified wedge shape.

BRIEF DESCRIPTION OF THE DRAWINGS

The foregoing features and advantages of the present subject matter will be apparent from the following more particular description of preferred embodiments of the present subject matter, as illustrated in the accompanying drawings in which like reference characters refer to the same parts throughout the different views. The drawings are not necessarily to scale, emphasis instead being placed upon illustrating the principles of the subject matter disclosed.

DETAILED DESCRIPTION

Figure 1A:
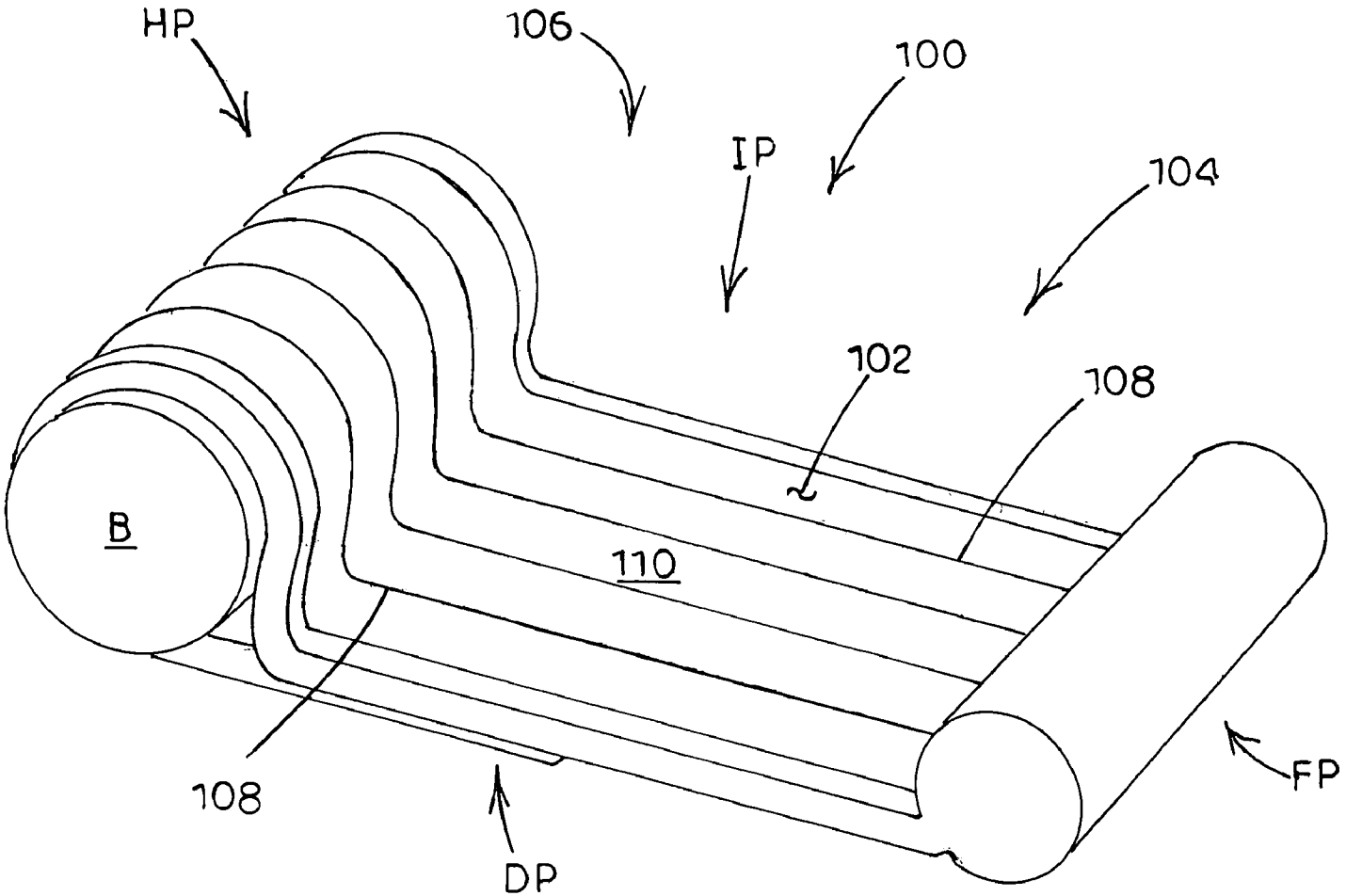
FIG. 1A illustrates a perspective view of an infant support apparatus with a cylindrical bolster.

FIGS. 1A through 12, wherein like parts are designated by like reference numerals throughout, illustrate examples of the infant support and development apparatus and method according to the present subject matter. Although this description is made with reference to the exemplary embodiments illustrated in the figures, it should be understood that many alternate forms can embody the present subject matter.

Figure 1B:
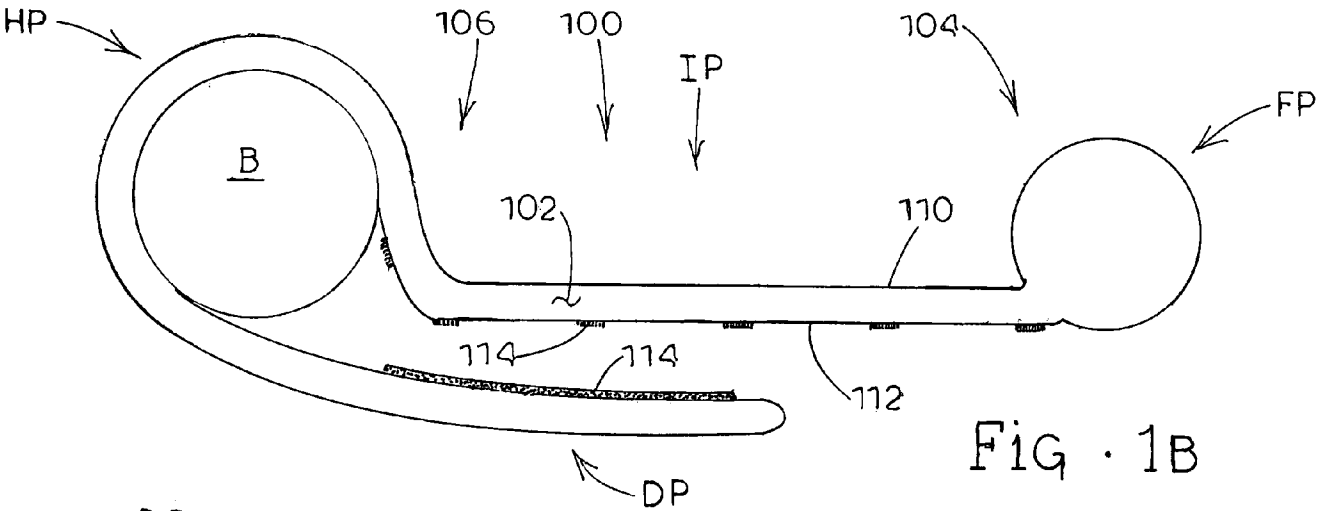
FIG. 1B illustrates a side view of the infant support apparatus of FIG. 1A.

FIGS. 1A and 1B illustrate perspective and side views, respectively, of an infant support apparatus generally designated 100 in accordance with the present disclosure. A support mat 102 is substantially elongate and has a first end generally designated 104 and a second end generally designated 106 thereof opposite first end 104. Support mat 102 can be 33 inches long and 18 inches wide. Any other suitable dimensions could be used as can be appreciated by those of skill in the art. Furthermore, support mat 102 can be contoured and have a plurality of recesses, such as recesses 108, which may include raised and lowered or recessed areas running in a longitudinal direction from first end 104 to second end 106 of support mat 102, thereby facilitating maintaining an infant on support mat 102. One of ordinary skill in the art will appreciate that support mat 102 may be smooth, flat, or have any contoured surface for maintaining an infant on infant support apparatus 100. Also, support mat 102 can be of various shapes and sizes as the configuration shown and described is not intended to limit the many possible configurations.

To provide cushioning for an infant, support mat 102 may be of sufficient thickness such that, upon falling on support mat 102, the infant will not be injured. Cushioning materials for support mat 102 may include foam, pillow-like stuffing, or any suitable material for providing a cushion. Materials for constructing support mat 102 may include any suitable material needed for maintaining the integrity of support mat 102 which can include vinyl or any fabric-like material adequately durable to resist tears and the like. Support mat 102 can also be constructed only of cloth with or without cushioning.

Additionally, a foot portion generally designated FP can be integral with support mat 102 and positioned at first end 104. By providing a resilient structure that can extend in use above a top side 110 of support mat 102, foot portion FP aids the development of musculature in the lower extremities of an infant as the feet of the infant can apply force by pushing against and exerting pressure upon foot portion FP, thereby strengthening leg muscles, as further described hereinbelow. Foot portion FP can extend entirely or partially along and parallel to first end 104. Foot portion FP can be of at least a generally cylindrical shape, or can be of any other suitable shape or size. As shown, foot portion FP can be approximately 4 inches in diameter. Also, foot portion FP may be solid or hollow, but resilient to the force exerted by the feet and legs of an infant. Foot portion FP can be integral with support mat 102, or can be attached to support mat 102 with any suitable fasteners, such as snaps, hook and loop type fasteners, or a zipper.

A bolster B can be positioned at second end 106 of support mat 102. As shown in one aspect in FIG. 1A, bolster B can be of an at least generally cylindrical shape. Second end 106 of support mat 102 is adapted for overwrapping at least a portion of bolster B to form a head portion, generally designated HP, for supporting an infant as describe further below. Support mat 102 can be retracted or extended to accommodate the growth of an infant by positioning bolster B either closer to or further away from foot portion FP to obtain a desired length. In other words, the length of support mat 102 between foot portion FP and bolster B, referred to herein as an intermediate support portion generally designated IP, is adjustable by adjusting an amount of overwrapping of support mat 102 around bolster B. For example, support mat 102 can be placed over bolster B and wrapped around bolster B, whereby a distal portion generally designated DP of support mat 102 can be fastened to intermediate support portion IP. Bolster B can be 6 inches long and 18 inches wide. A cross-sectional distance of bolster B may be greater than a cross-sectional distance of foot portion FP. Construction materials for bolster B can include foam, plastic, fabric with pillow stuffing, or any other suitable material or combination of materials.

Figure 1C:
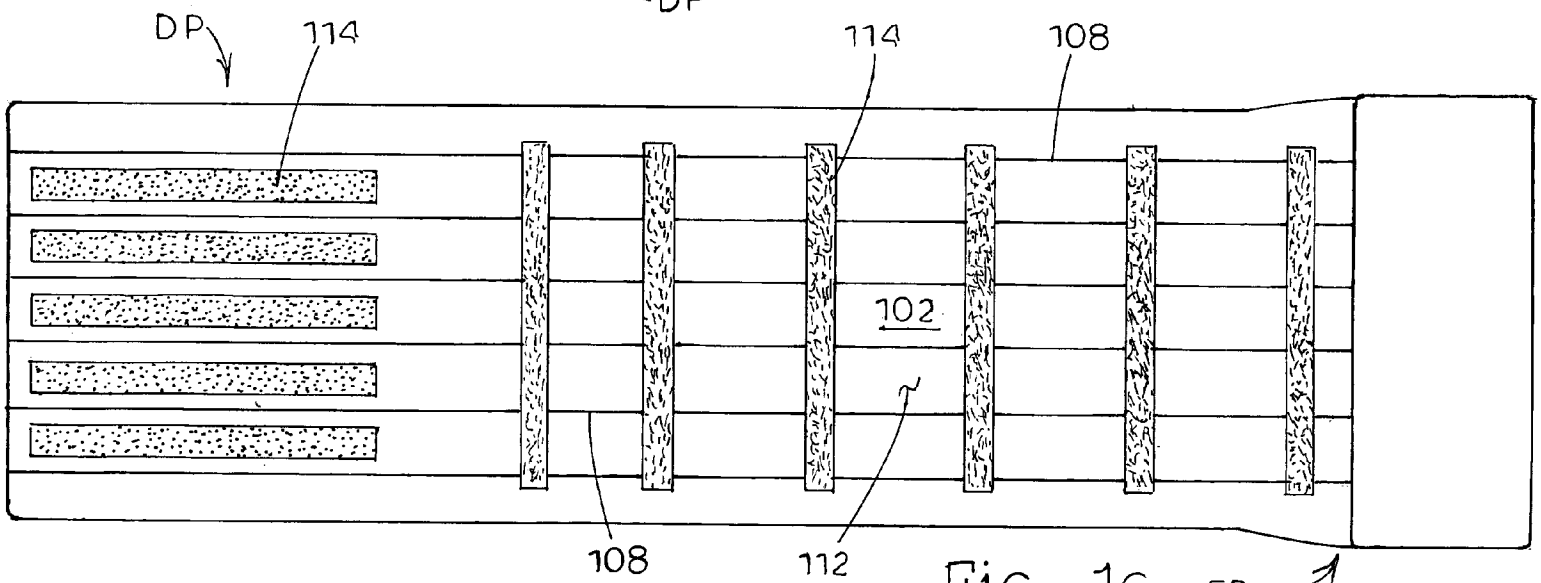
FIG. 1C illustrates a bottom plan view of the infant support apparatus of FIG. 1A in an unrolled position and without the cylindrical bolster.
Figure 1D:
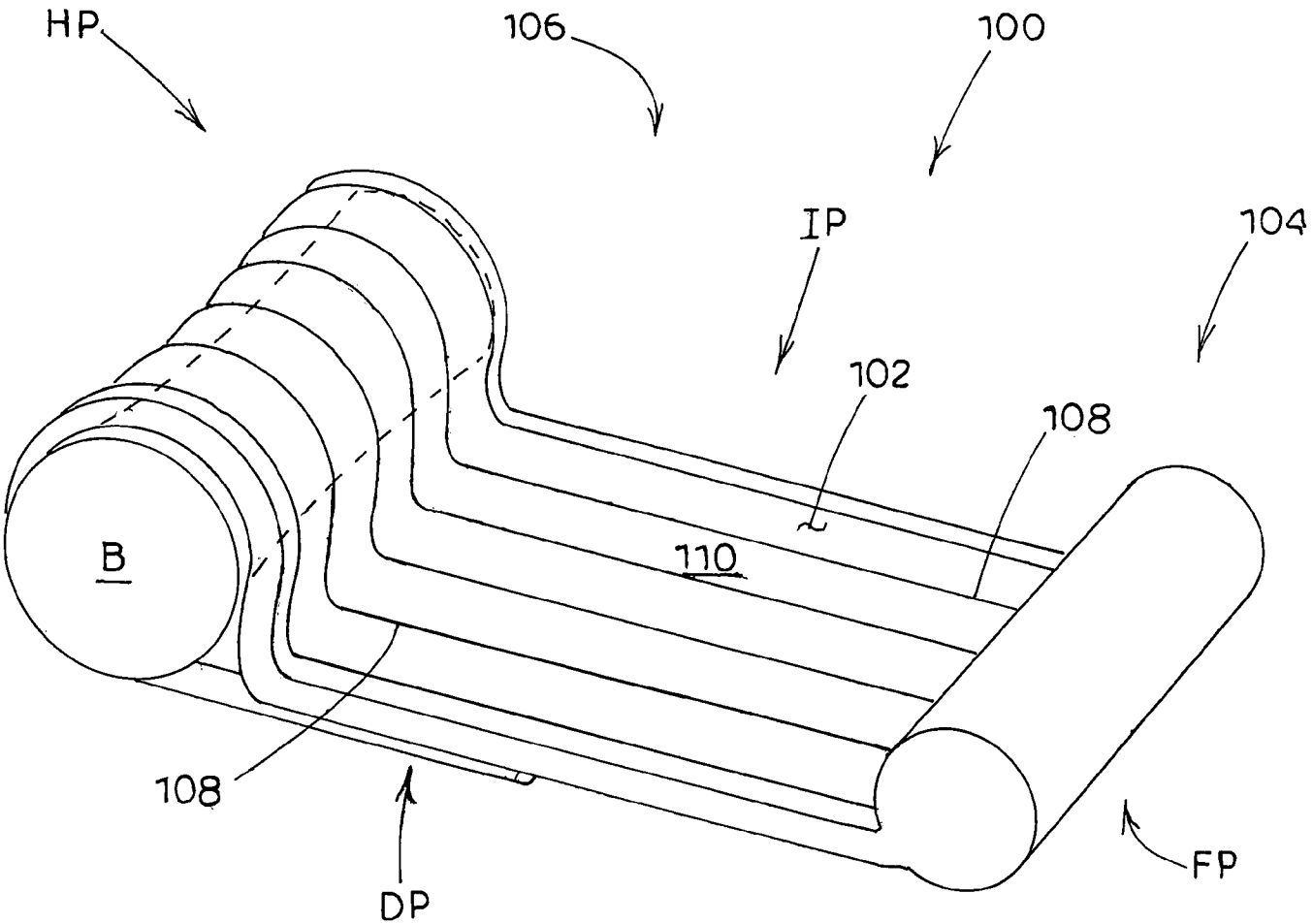
FIG. 1D illustrates a perspective view of an infant support apparatus with an hourglass bolster.

As shown in FIGS. 1B and 1C, support mat 102 has a bottom side 112 with hook and loop type fasteners 114 disposed thereon for fastening with hook and loop type fasteners 114 on distal portion DP. As more clearly shown in FIG. 1B, when support mat 102 is wrapped around bolster B, distal portion DP of support mat 102 can fasten to intermediate support portion IP on bottom side 112 by hook and loop type fasteners 114. In other words, support mat 102 curls back underneath itself to attach thereto. This positioning permits bolster B to be positioned at different lengths along support mat 102 to accommodate infant growth by attaching distal portion DP at different points along intermediate support portion IP. Hook and loop type fasteners 114 or any other suitable fasteners may be positioned and attached in any orientation and in any way on bottom side 112 for securing distal portion DP of support mat 102 to intermediate support portion IP after wrapping around bolster B. Bolster B may be solid or hollow and of any shape or size. For example, FIG. 1D shows bolster B with an hourglass shape.

Figure 2A:
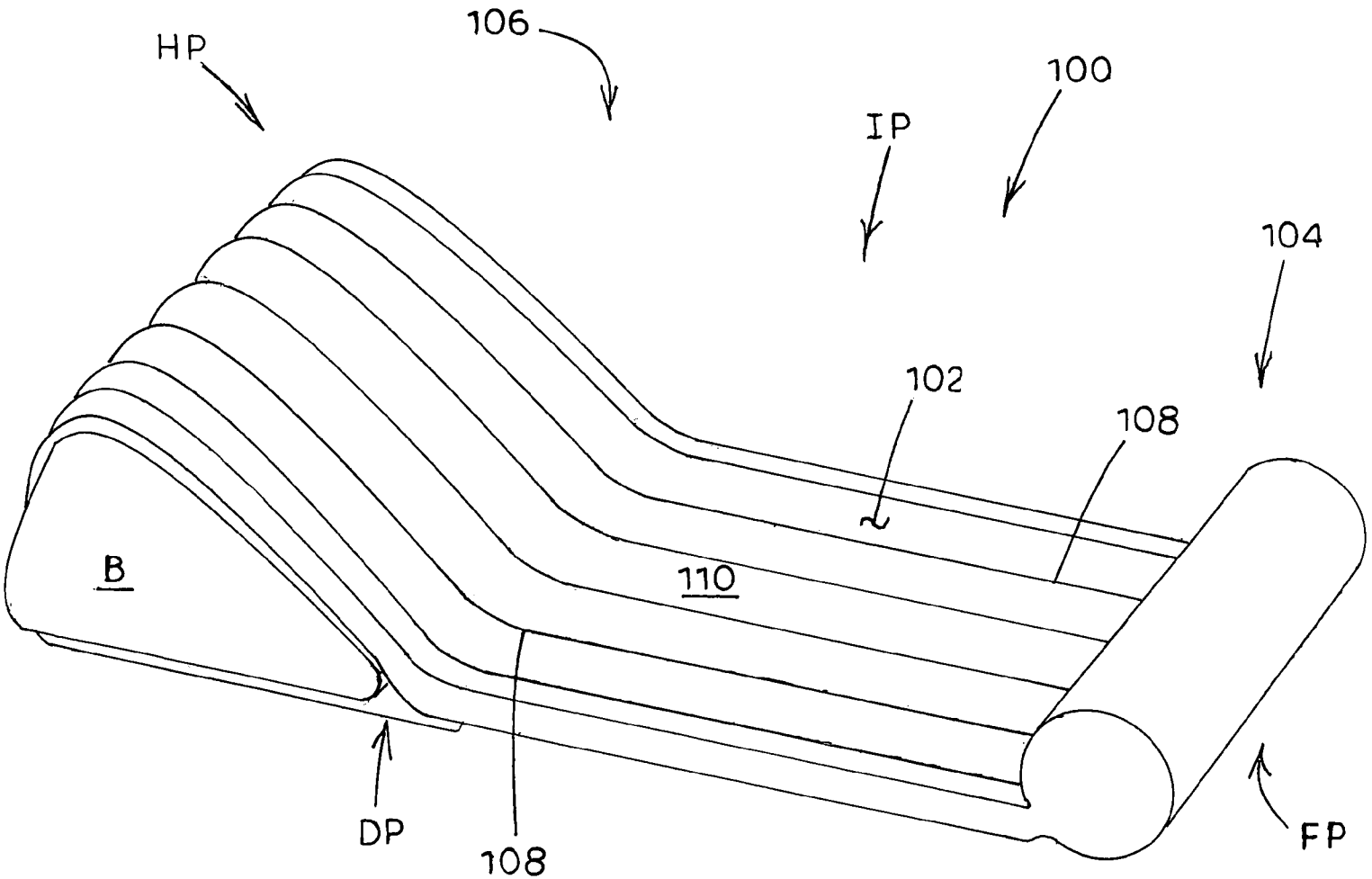
FIG. 2A illustrates a perspective view of an infant support apparatus with a wedge bolster.
Figure 2B:
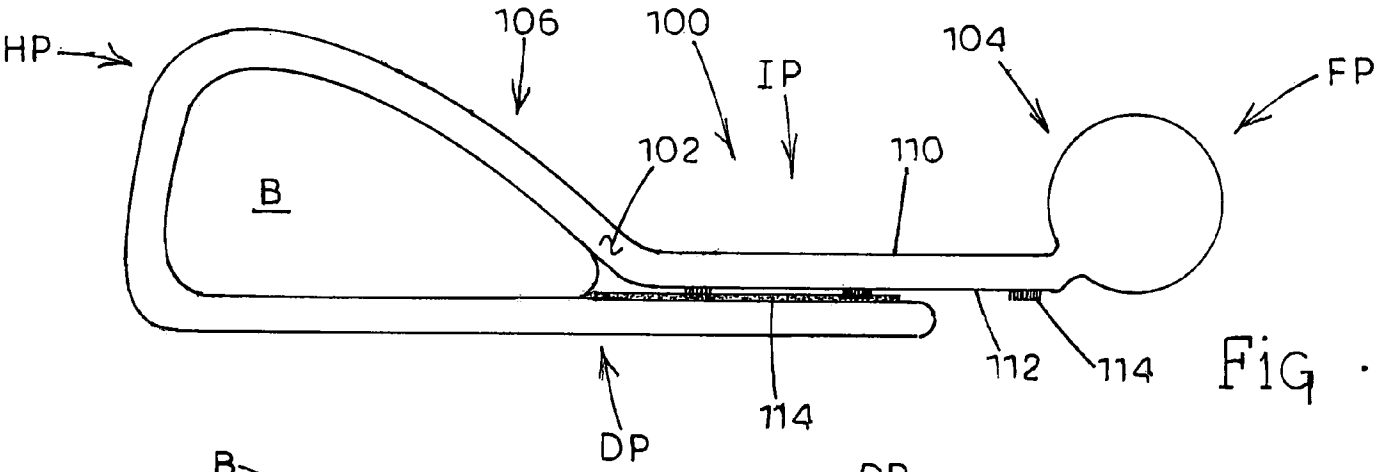
FIG. 2B illustrates a side view of the infant support apparatus of FIG. 2A.
Figure 2C:
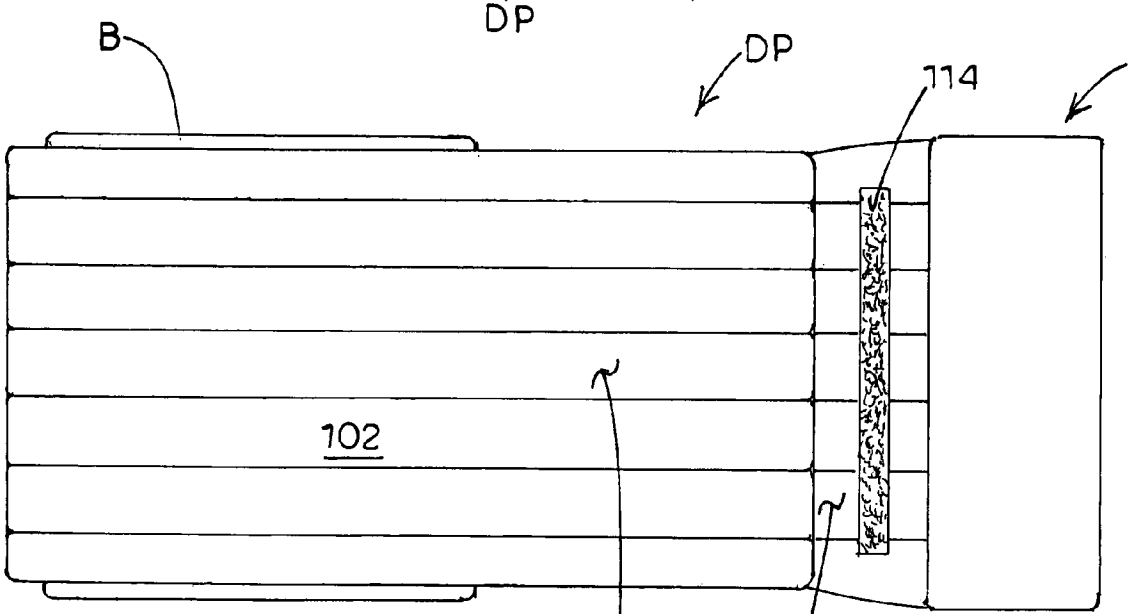
FIG. 2C illustrates a bottom plan view of the infant support apparatus of FIG. 2A.

FIGS. 2A–2B and 3A–3B similarly illustrate infant support apparatus 100 as shown in FIGS. 1A–1B, but instead with alternate shapes for bolster B. As seen in FIGS. 2A–2B, bolster B is in the shape of a wedge, thereby providing inclined support to an infant while the feet of the infant can engage foot portion FP while in a either a prone or supine position as described further hereinbelow. FIG. 2C is a bottom plan view of infant support apparatus 100 of FIG. 2A and FIG. 2B. In FIG. 2C, support mat 102 is wrapped around bolster B and distal portion DP is fastened to bottom side 112 of intermediate support portion IP by hook and loop type fasteners 114.

Figure 3A:
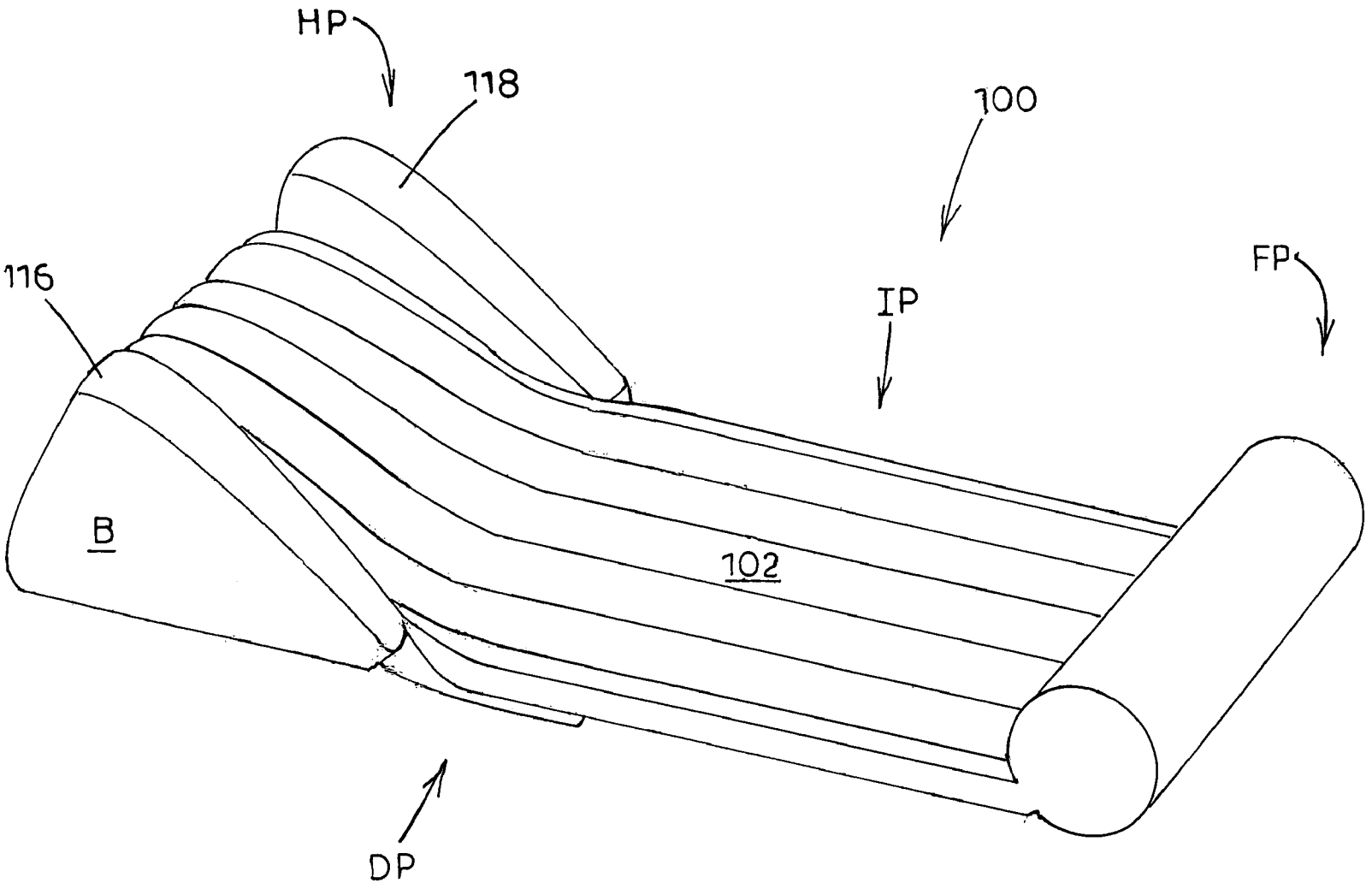
FIG. 3A illustrates a perspective view of an infant support apparatus with a modified wedge bolster.
Figure 3B:
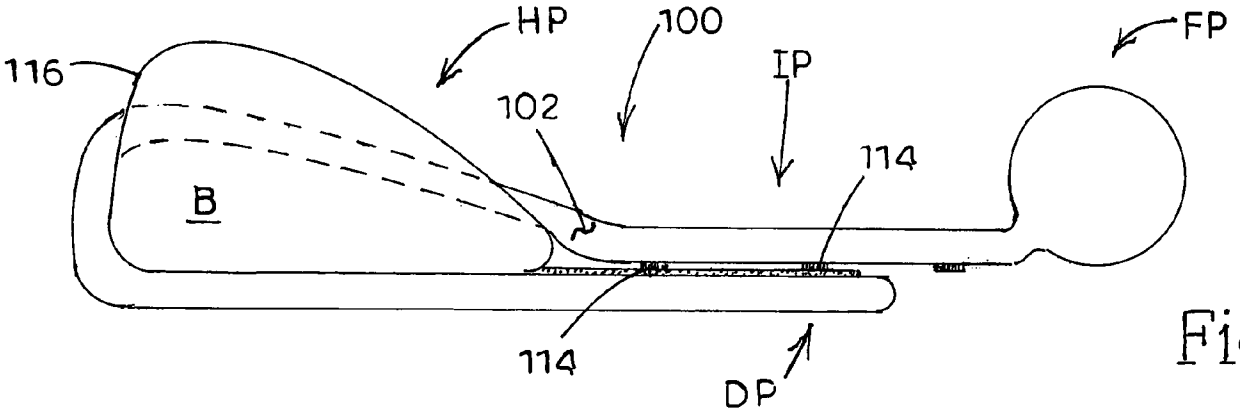
FIG. 3B illustrates a side view of the infant support apparatus of FIG. 3A.
Figure 3C:
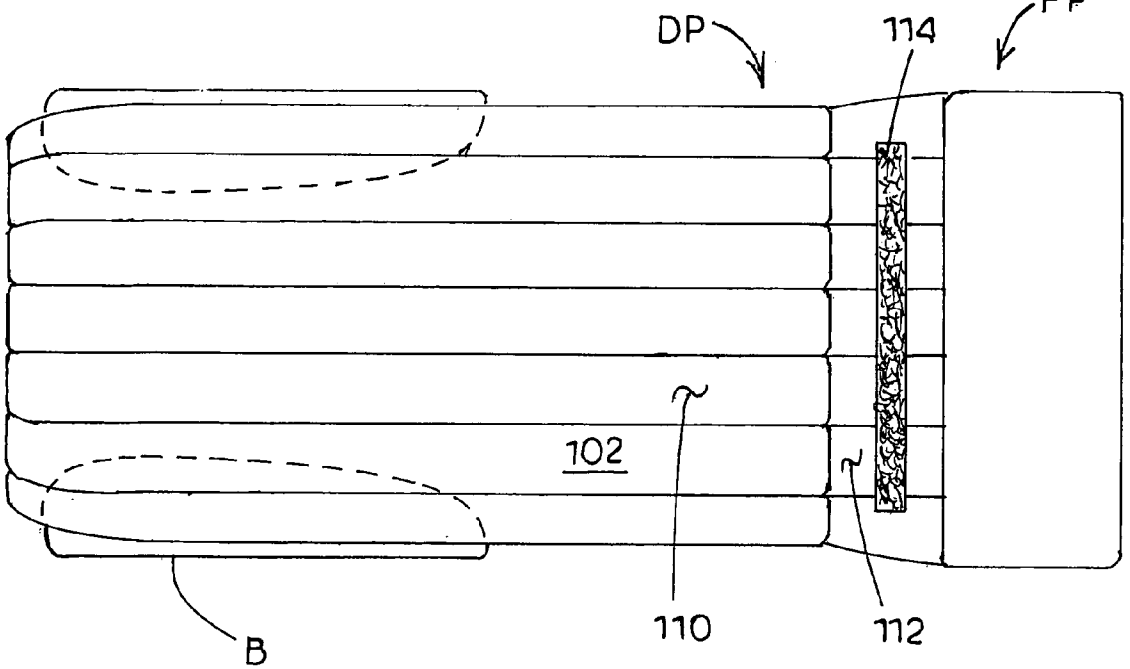
FIG. 3C illustrates a bottom plan view of the infant support apparatus of FIG. 3A.

As shown in FIGS. 3A–3B, bolster B is generally wedge-shaped with a first lateral support portion 116 and a second lateral support portion 118 that project from bolster B to cooperatively form a containment recess for providing lateral support and maintaining an infant on bolster B during use. Additionally, first lateral support portion 116 and second lateral support portion 118 can be spaced sufficiently apart to permit support mat 102 to pass therebetween and wrap around bolster B. FIG. 3C is a bottom plan view of infant support apparatus 100 of FIG. 3A. In FIG. 3C, support mat 102 is wrapped around bolster B and distal portion DP is fastened to bottom side 112 of intermediate support portion IP by hook and loop type fasteners 114.

Figure 4A:
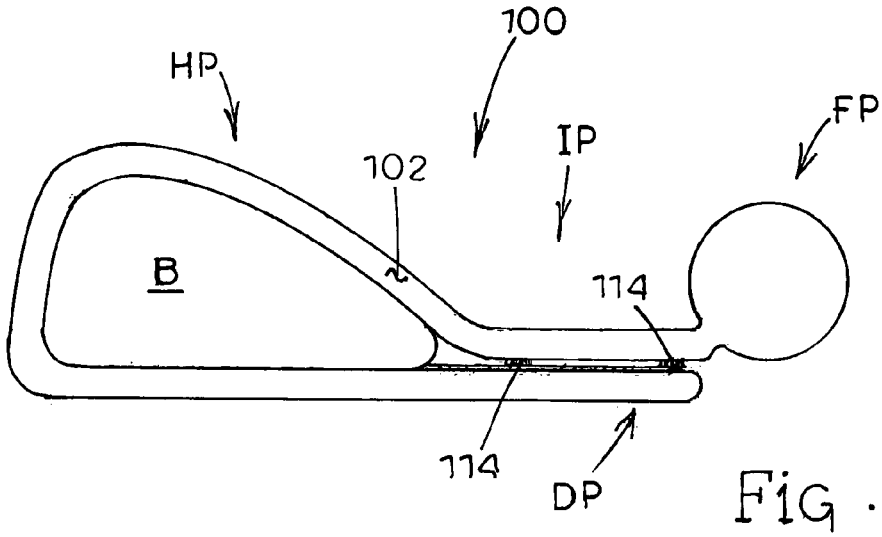
FIG. 4A illustrates a side view of an infant support apparatus wrapped around a wedge bolster with a support mat in a retracted position.
Figure 4B:
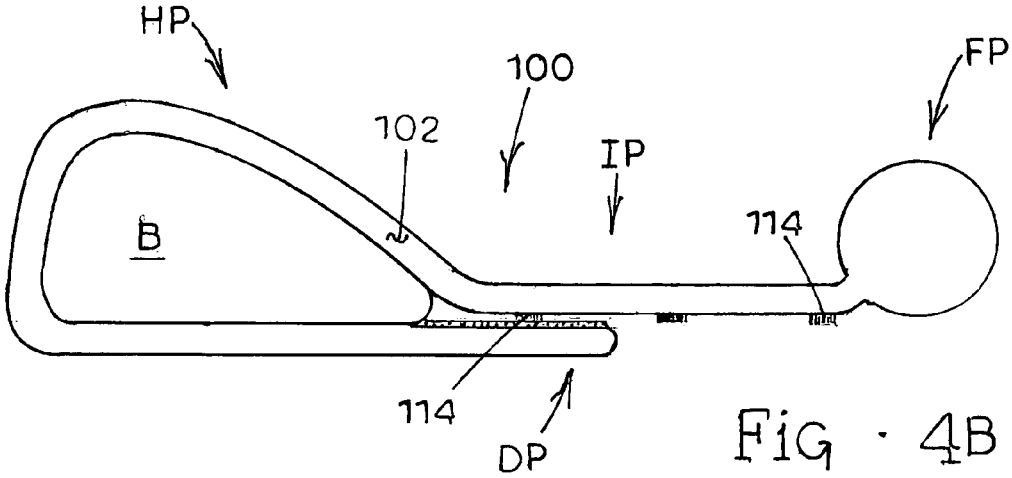
FIG. 4B illustrates a side view of the infant support apparatus of FIG. 4A with the support mat further extended.
Figure 4C:
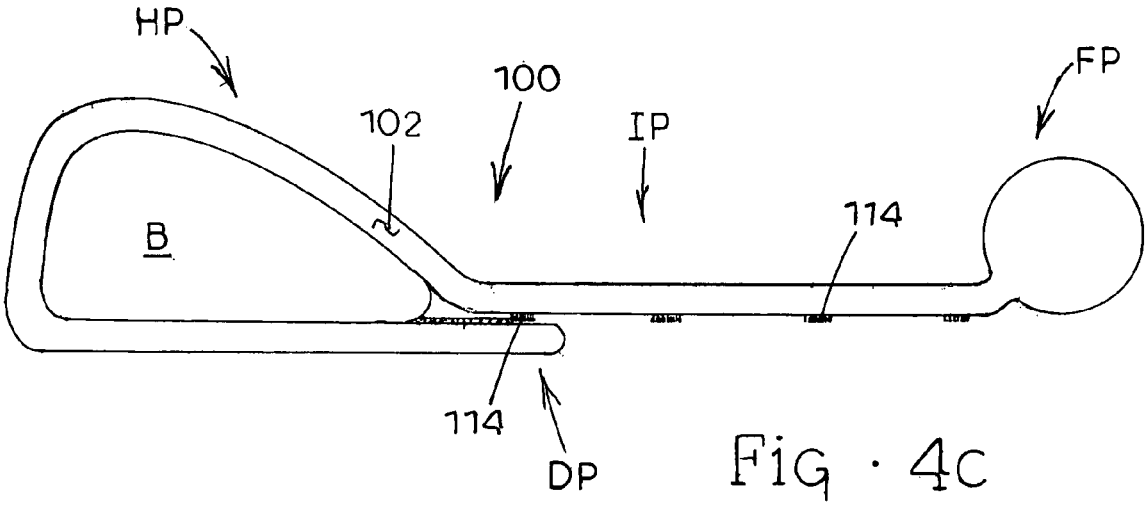
FIG. 4C illustrates a side view of the infant support apparatus of FIG. 4A with the support mat in even a further extended position from that shown in FIG. 4B.

FIGS. 4A–4C illustrate side views of infant support apparatus 100 in various wrapped positions for accommodating infant growth. FIG. 4A illustrates support mat 102 in a retracted position wherein intermediate support portion IP is of a short length as support mat 102 overwraps bolster B with distal portion DP extending nearly to or even past foot portion FP. FIG. 4B illustrates support mat 102 partially retracted with distal portion DP not extending as far or close to foot portion FP as in FIG. 4A. FIG. 4C illustrates support mat 102 wrapped around bolster B such that distal portion DP extends around bolster B but terminates much closer to bolster B than in FIG. 4A or 4B, therefore allowing for a greater length of intermediate support portion IP. As an infant grows, infant support apparatus 100 can be adjusted as desired to accommodate infant growth.

Figure 5A:
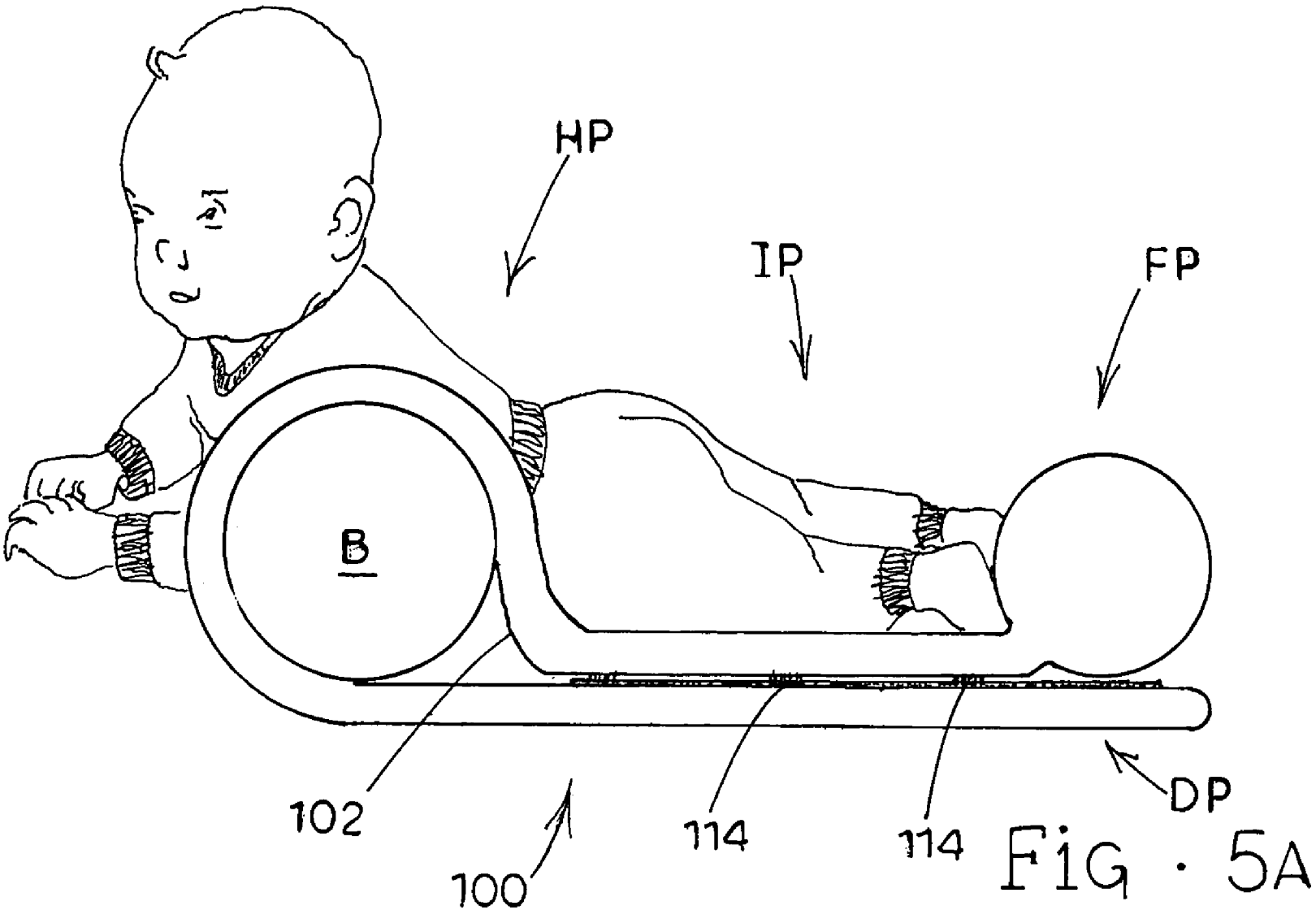
FIG. 5A illustrates a side view of an infant in a prone position on an infant support apparatus with a cylindrical bolster.
Figure 5B:
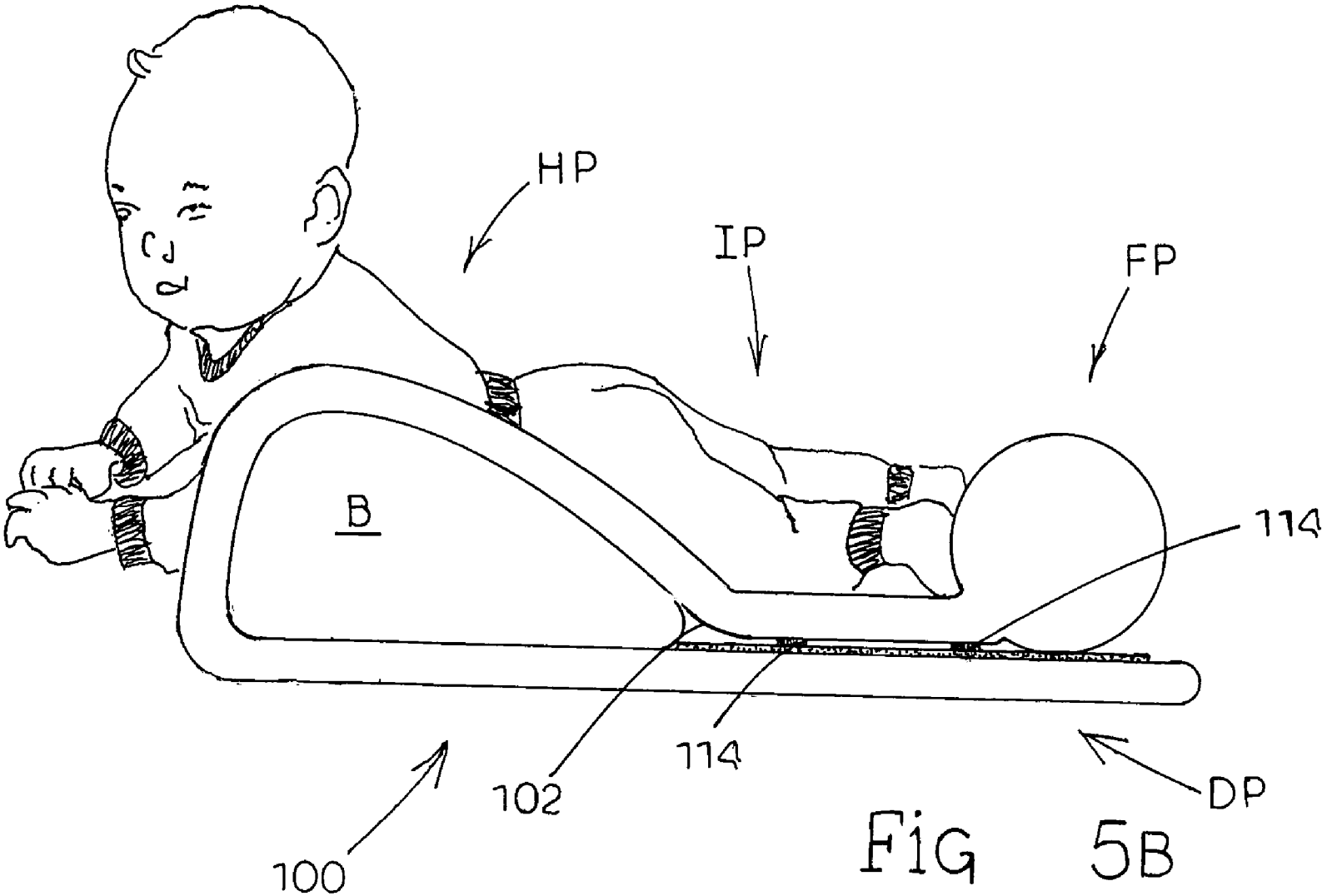
FIG. 5B illustrates a side view of an infant in a prone position on an infant support apparatus with a wedge bolster.
Figure 5C:
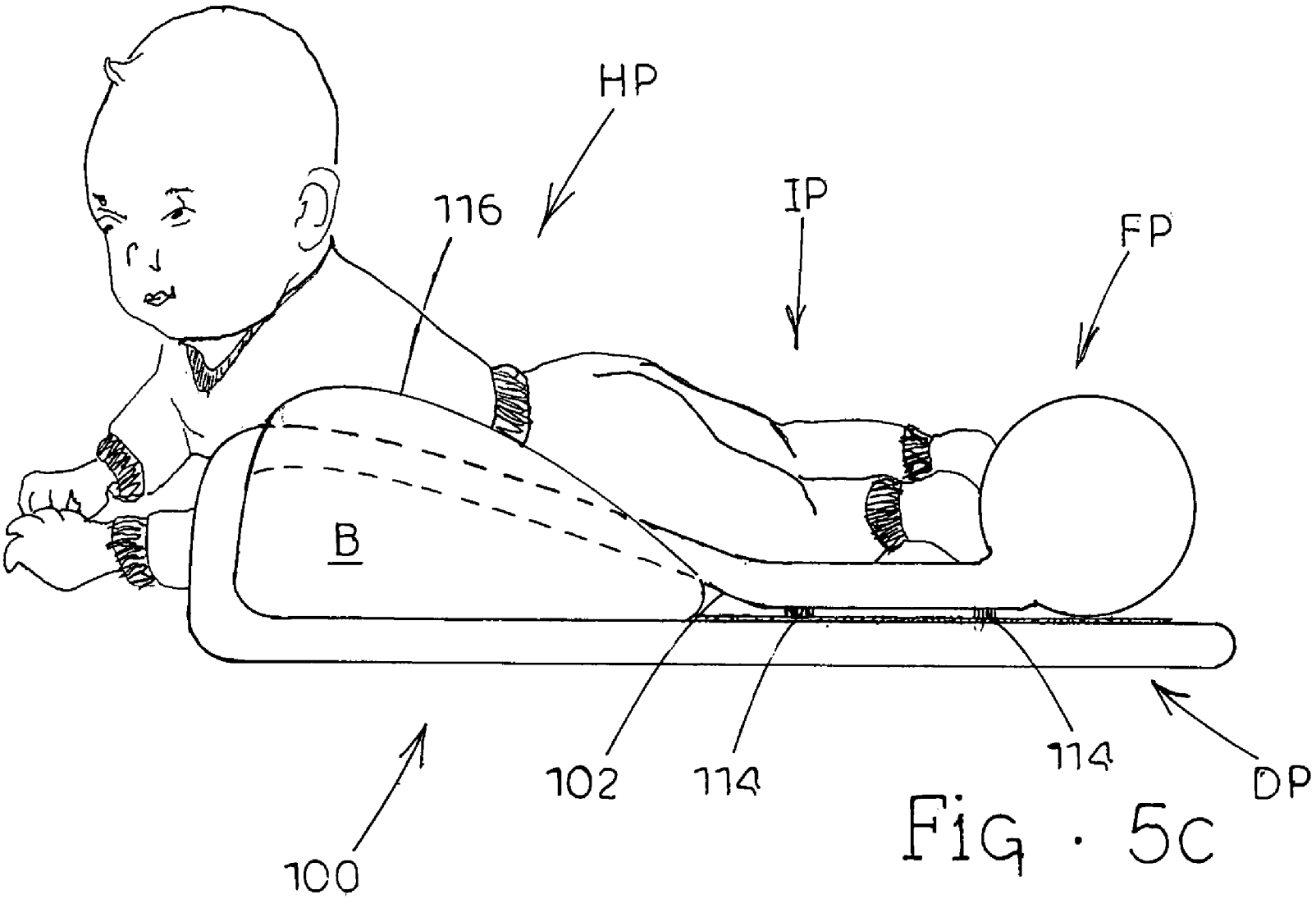
FIG. 5C illustrates a side view of an infant in a prone position on an infant support apparatus with a modified wedge bolster.

FIGS. 5A–5C illustrate side views of infant support apparatus 100 in use by an infant in a prone position. Accordingly, the head, and even a portion of the upper body, of an infant can be supported by bolster B while the infant is on infant support apparatus 100 as shown. FIG. 5A illustrates an infant engaging infant support apparatus 100 comprising bolster B with a generally cylindrical shape. FIG. 5B illustrates an infant engaging infant support apparatus 100 comprising bolster B with a wedge shape. FIG. 5C illustrates an infant using infant support apparatus 100 comprising bolster B with a modified wedge shape having lateral supports. As seen in FIG. 5C, the feet of an infant in a prone position can engage foot portion FP while the upper body of the infant can extend on and over head portion HP.

Figure 6A:
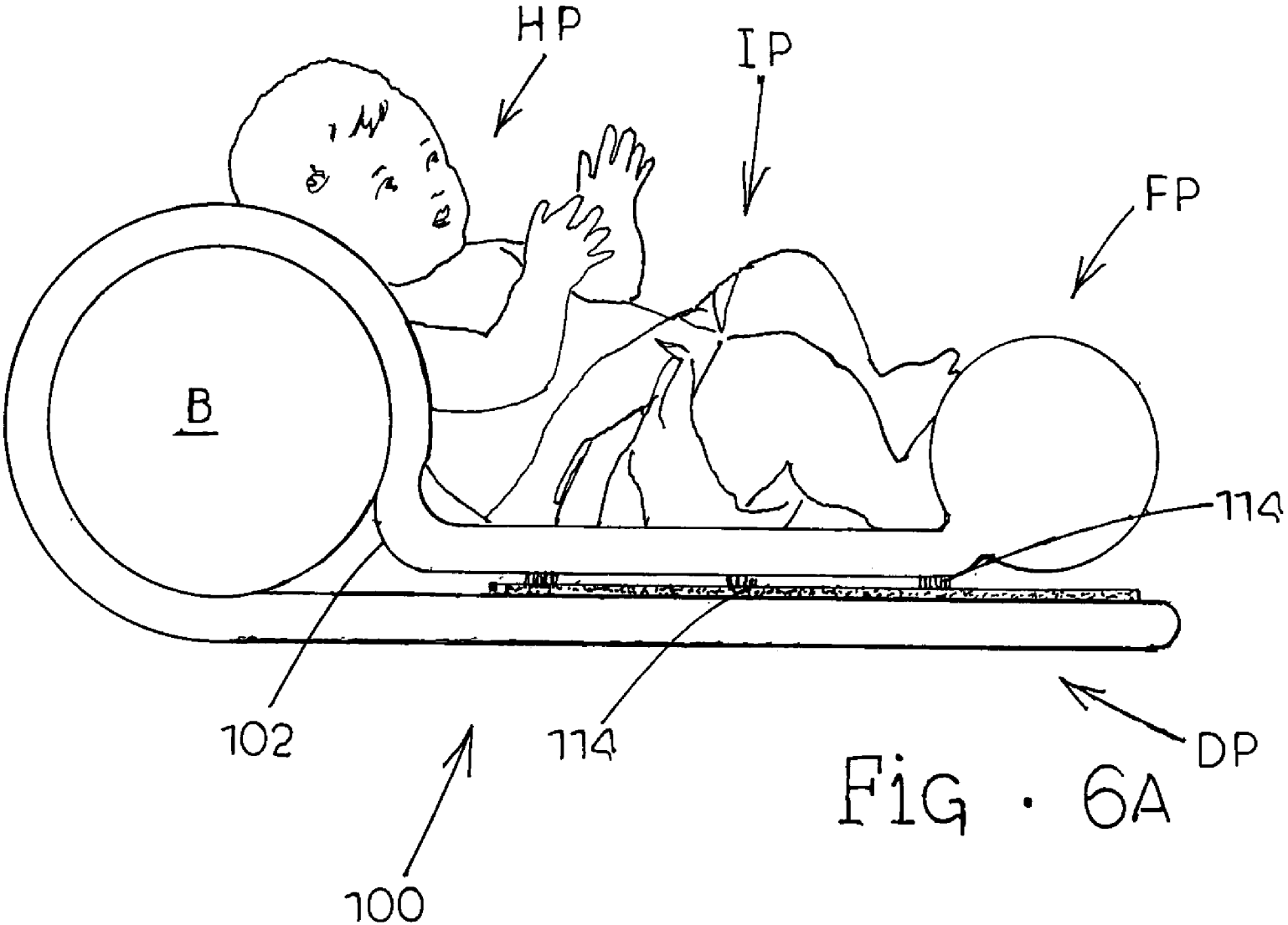
FIG. 6A illustrates a side view of an infant in a supine position on an infant support apparatus with a cylindrical bolster.
Figure 6B:
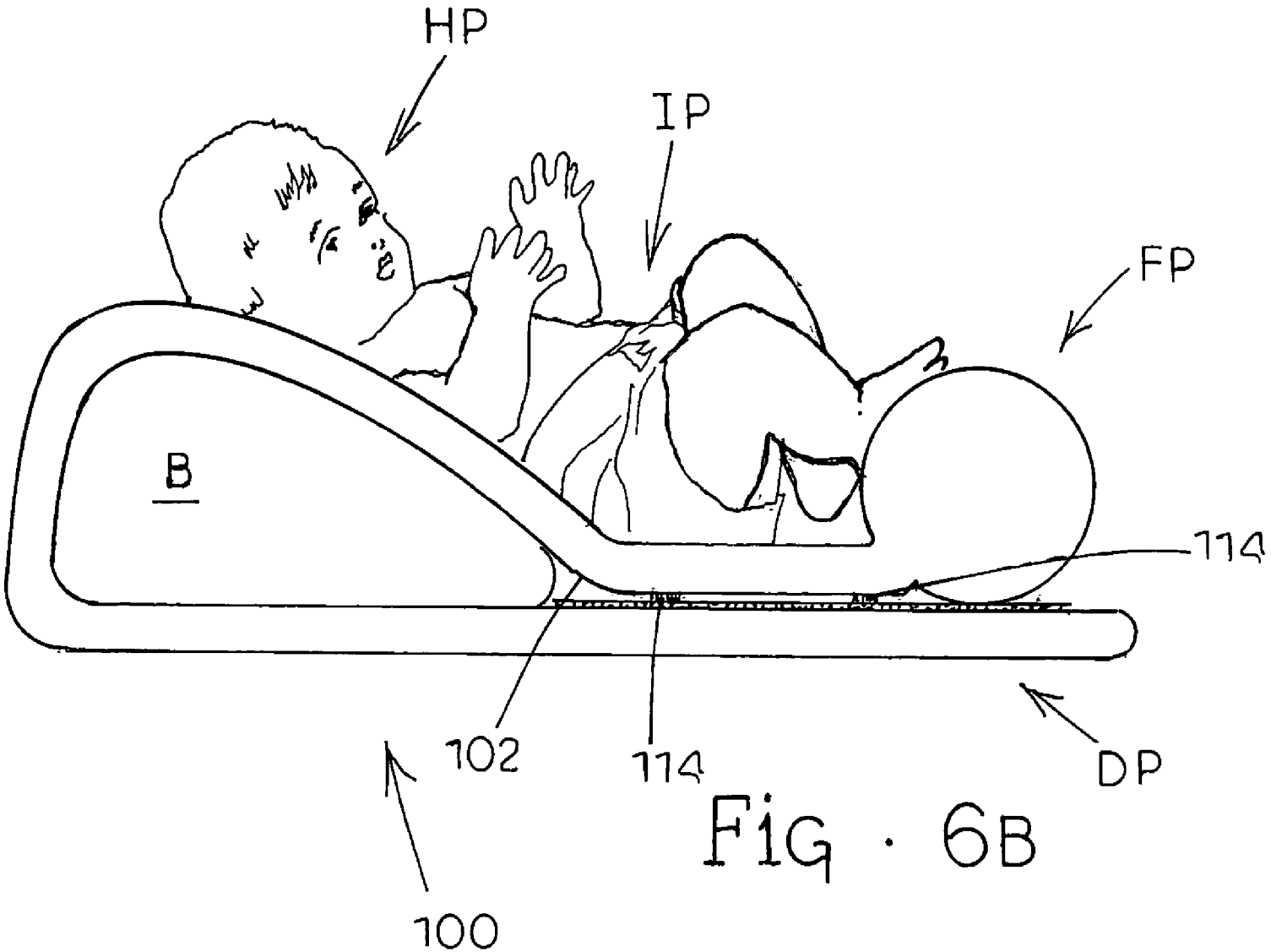
FIG. 6B illustrates a side view of an infant in a supine position on an infant support apparatus with a wedge bolster.
Figure 6C:
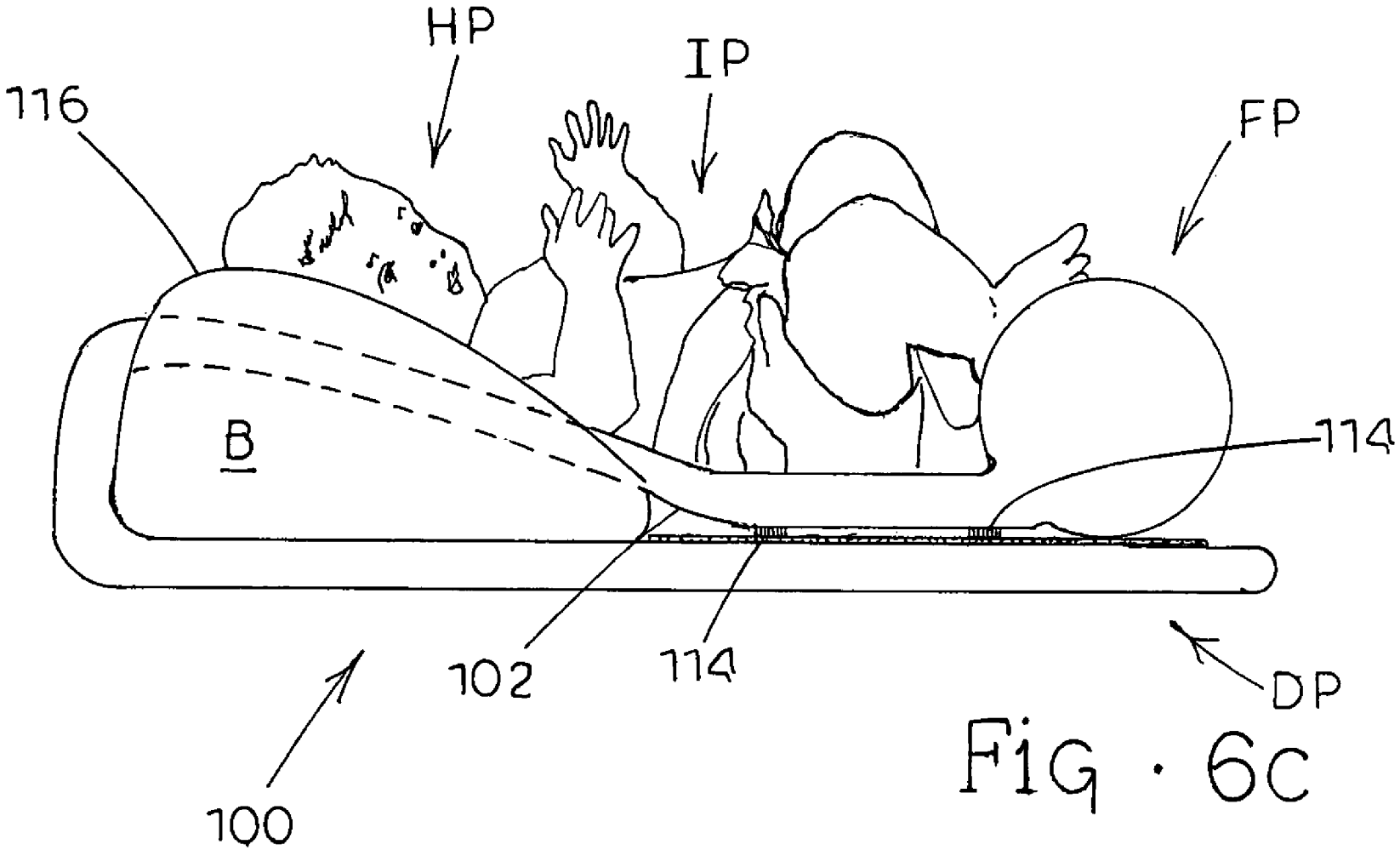
FIG. 6C illustrates a side view of an infant in a supine position on an infant support apparatus with a modified wedge bolster.

FIGS. 6A–6C illustrate side views of infant support apparatus 100 in use by an infant in a supine position. Accordingly, the head, and even a portion of the upper body, of an infant can be supported by bolster B while the infant is on infant support apparatus 100 as shown. FIG. 6A illustrates an infant engaging infant support apparatus 100 comprising bolster B with a generally cylindrical shape. FIG. 6B illustrates an infant engaging infant support apparatus 100 comprising bolster B with a wedge shape. FIG. 6C illustrates an infant using infant support apparatus 100 comprising bolster B with a modified wedge shape having lateral supports. As shown in FIG. 6C, the feet of the infant in a supine position again can engage foot portion FP and the head and the upper body of the infant can be supported at least partially by head portion HP.

Figure 7A:
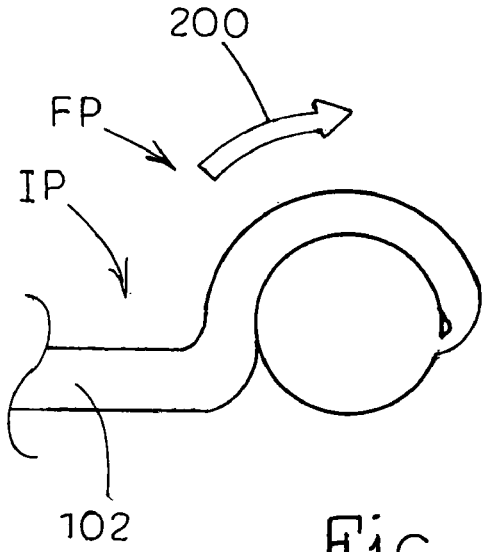
FIG. 7A illustrates a side view of an alternate embodiment of a partial infant support mat and foot portion rolled in a first direction.
Figure 7B:
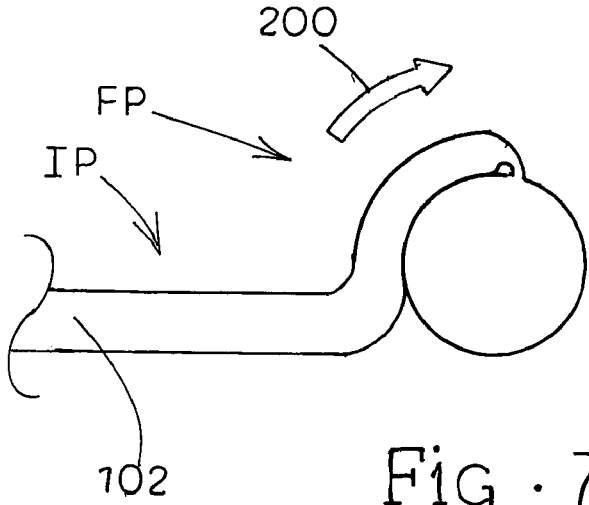
FIG. 7B illustrates a side view of the partial infant support mat and foot portion with the infant support mat extended from the position shown in FIG. 7A.
Figure 7C:
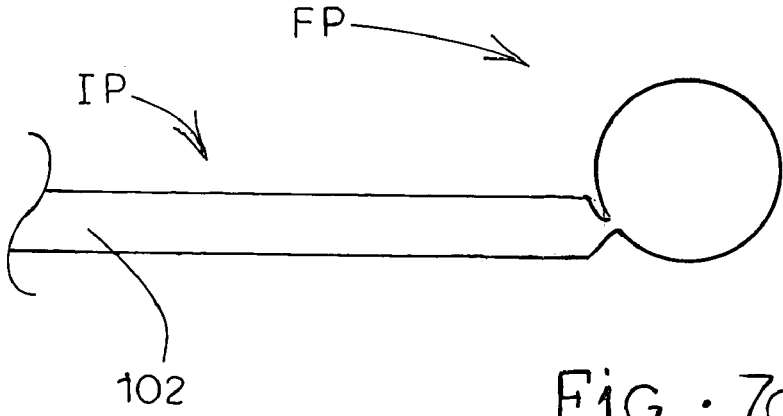
FIG. 7C illustrates a side view of the partial infant support mat and foot portion of FIG. 7A with the infant support mat extended even further from the position shown in FIG. 7B.

As an alternate embodiment, FIGS. 7A–7C illustrate side views of a portion of support mat 102 in variously rolled positions for accommodating infant growth. FIG. 7A illustrates support mat 102 rolled nearly completely around foot portion FP in a first direction 200, thereby minimizing the length of intermediate support portion IP. FIG. 7B illustrates support mat 102 in a position rolled less around foot portion FP than in FIG. 7A which increases the length of intermediate support portion IP. FIG. 7C illustrates support mat 102 fully extended whereby support mat 102 is not rolled at all around foot portion FP in order to provide a maximum length for intermediate support portion IP.

Figure 8A:
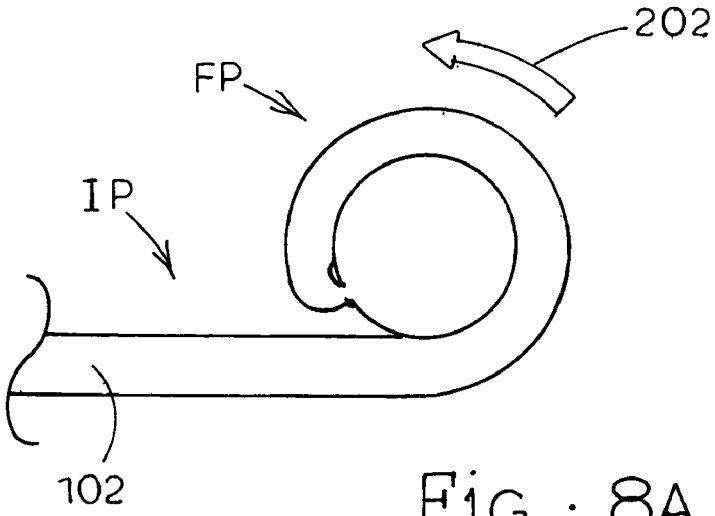
FIG. 8A illustrates a side view of an alternate embodiment of a partial infant support mat and foot portion rolled in a second direction.
Figure 8B:
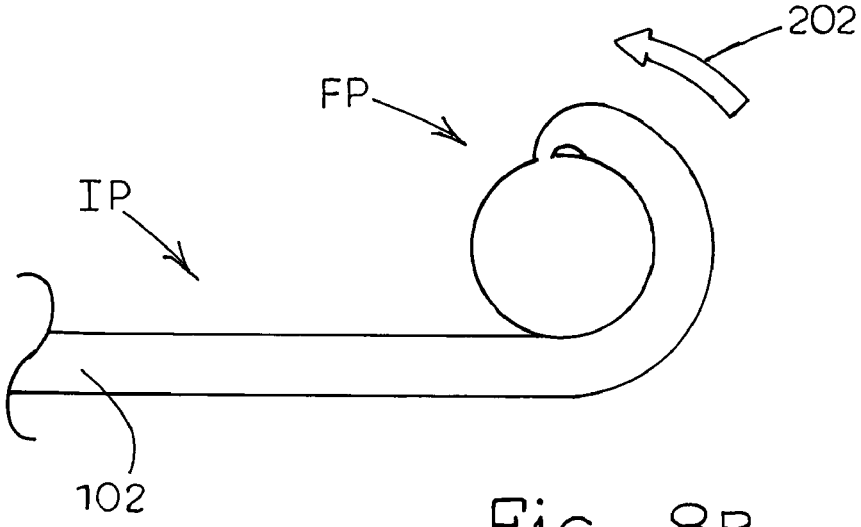
FIG. 8B illustrates a side view of the partial infant support mat and foot portion with the infant support mat extended from the position in FIG. 8A.
Figure 8C:
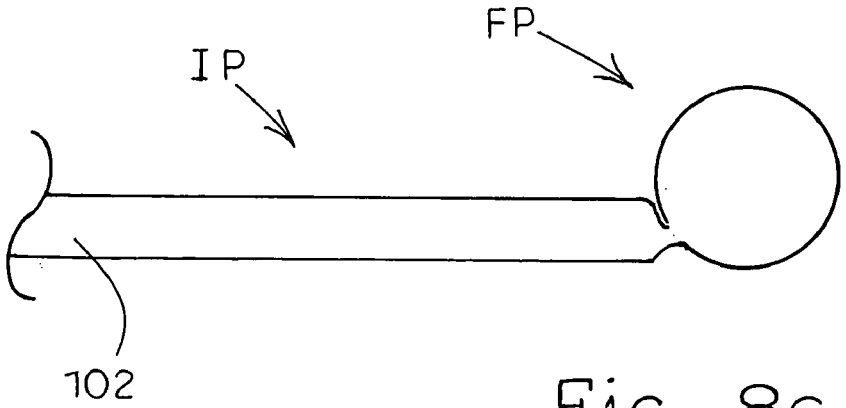
FIG. 8C illustrates a side view of the partial infant support mat and foot portion of FIG. 8A with the infant support mat extended even further from the position shown in FIG. 8B.

FIGS. 8A–8C illustrate similar features to those of FIGS. 7A–7C, but show instead foot portion FP rolled in a second direction 202. FIG. 8A illustrates support mat 102 rolled nearly completely around foot portion FP in second direction 202, thereby minimizing the length of intermediate support portion IP. FIG. 8B illustrates support mat 102 in a position rolled less around foot portion FP than in FIG. 8A which increases the length of intermediate support portion IP. FIG. 8C illustrates support mat 102 fully extended whereby support mat 102 is not rolled at all around foot portion FP in order to provide a maximum length for intermediate support portion IP.

Figure 9A:
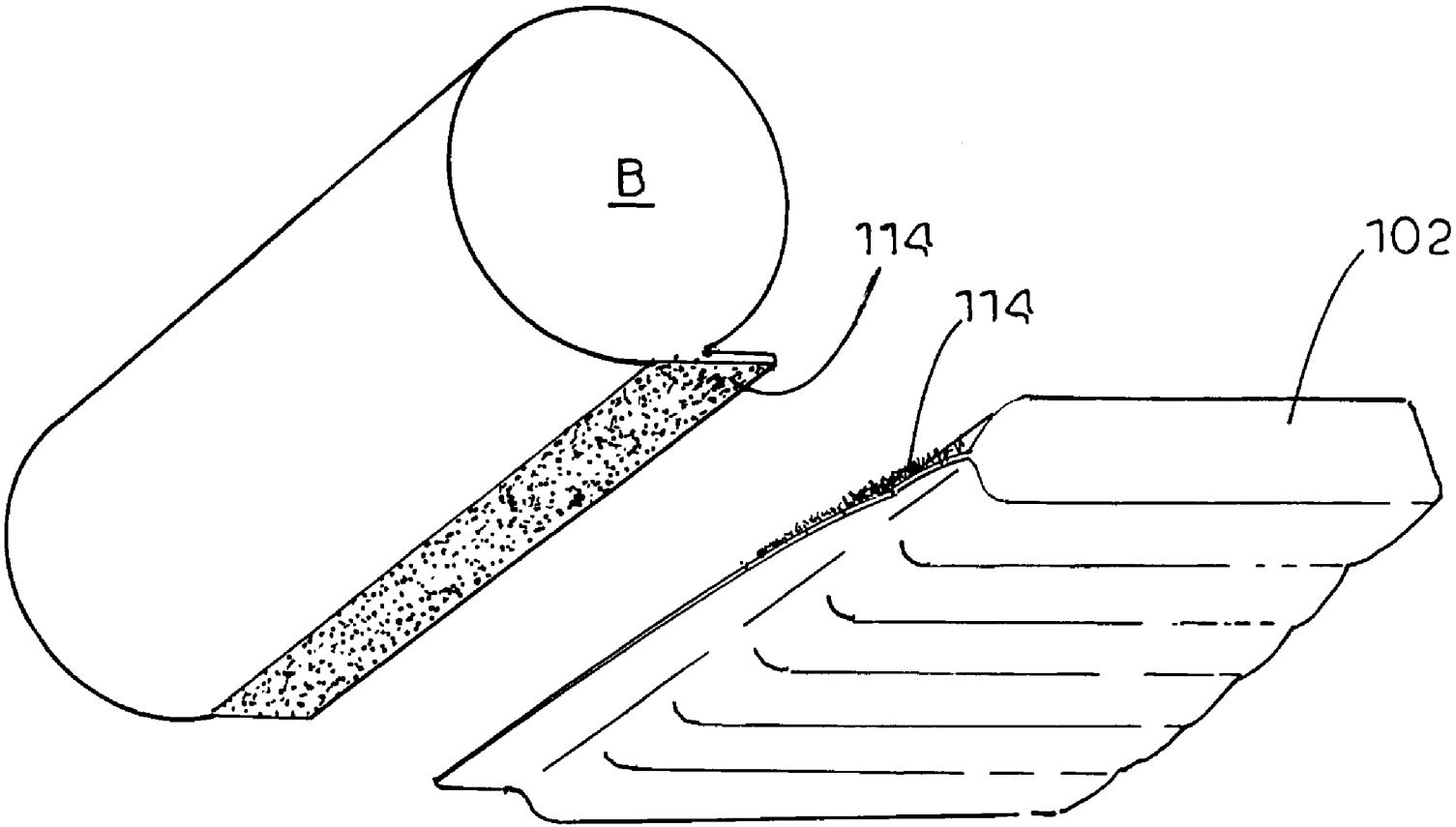
FIG. 9A illustrates a bottom perspective view of a portion of an infant support mat with a cylindrical bolster attachable by hook and loop type fasteners.
Figure 9B:
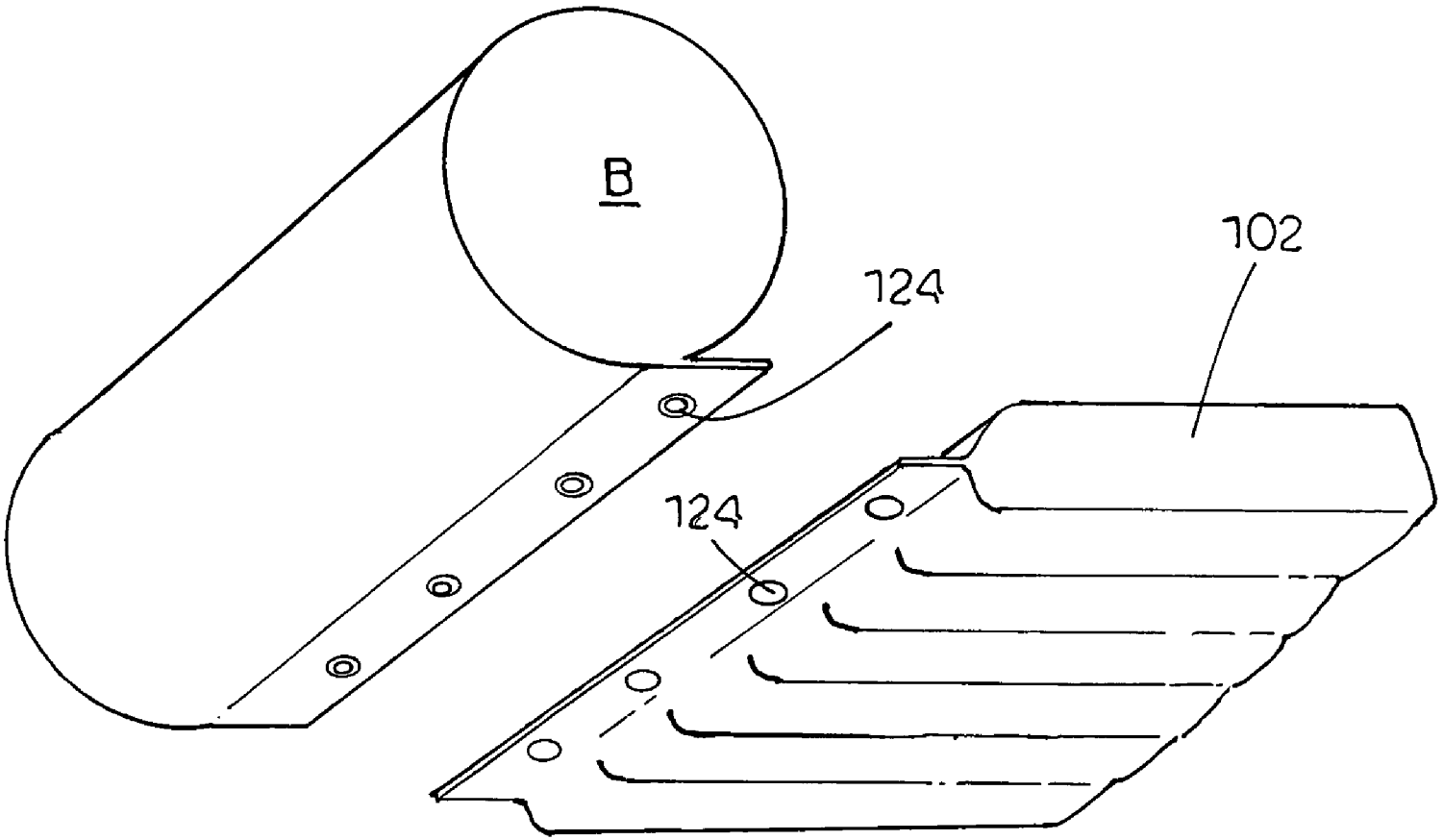
FIG. 9B illustrates a bottom perspective view of a portion of an infant support mat attachable to a cylindrical bolster by snaps.
Figure 9C:
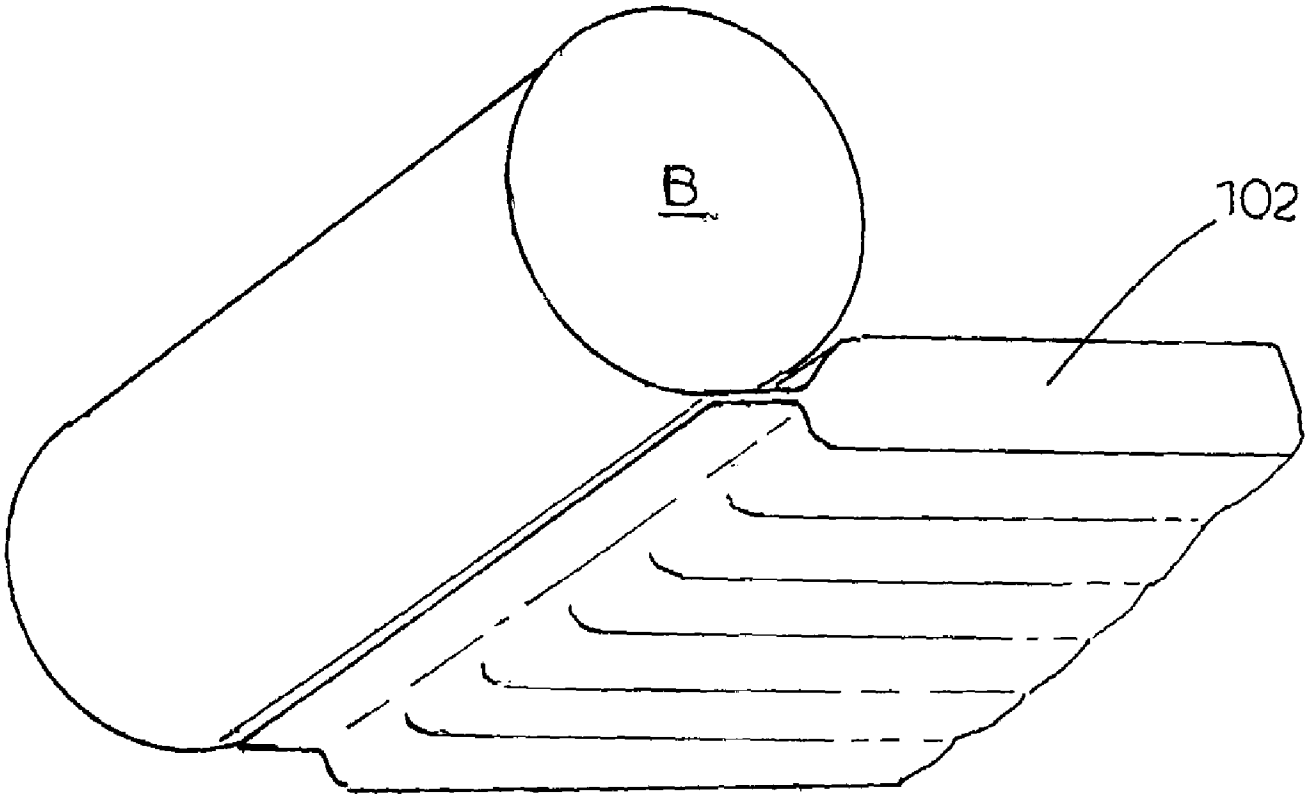
FIG. 9C illustrates a bottom perspective view of a portion of an infant support mat integral with a cylindrical bolster.
Figure 10A:
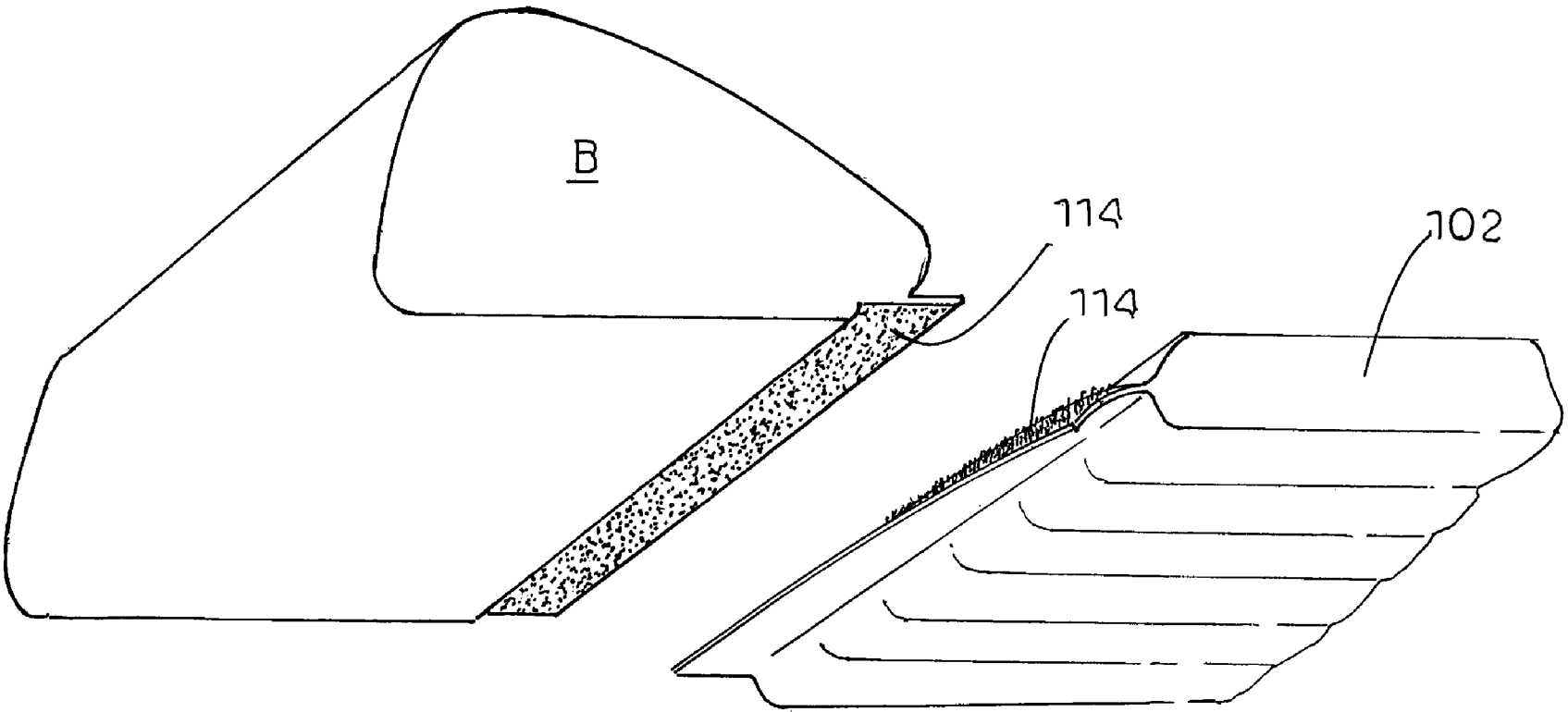
FIG. 10A illustrates a bottom perspective view of a portion of an infant support mat with a wedge bolster attachable by hook and loop type fasteners.
Figure 10B:
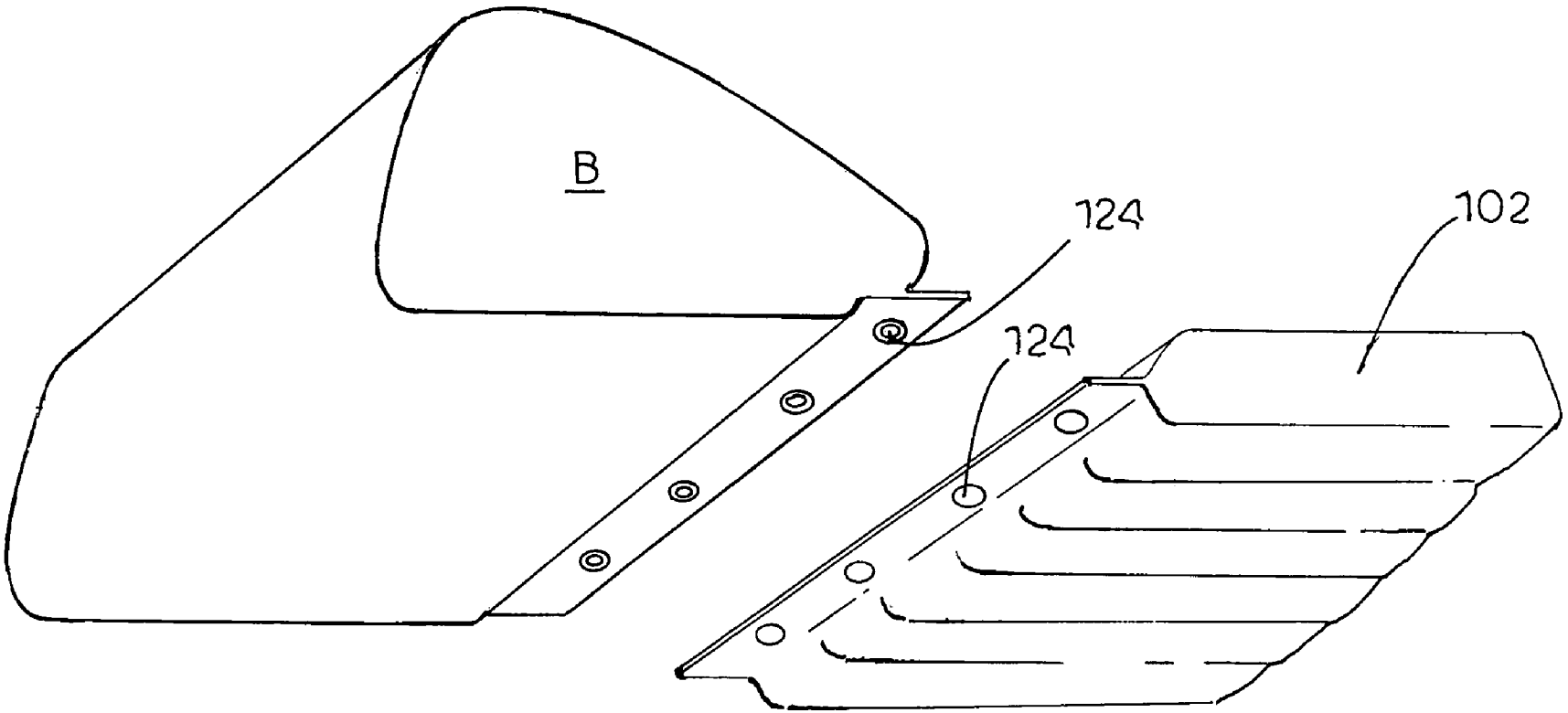
FIG. 10B illustrates a bottom perspective view of a portion of an infant support mat attachable to a wedge bolster by snaps.
Figure 10C:
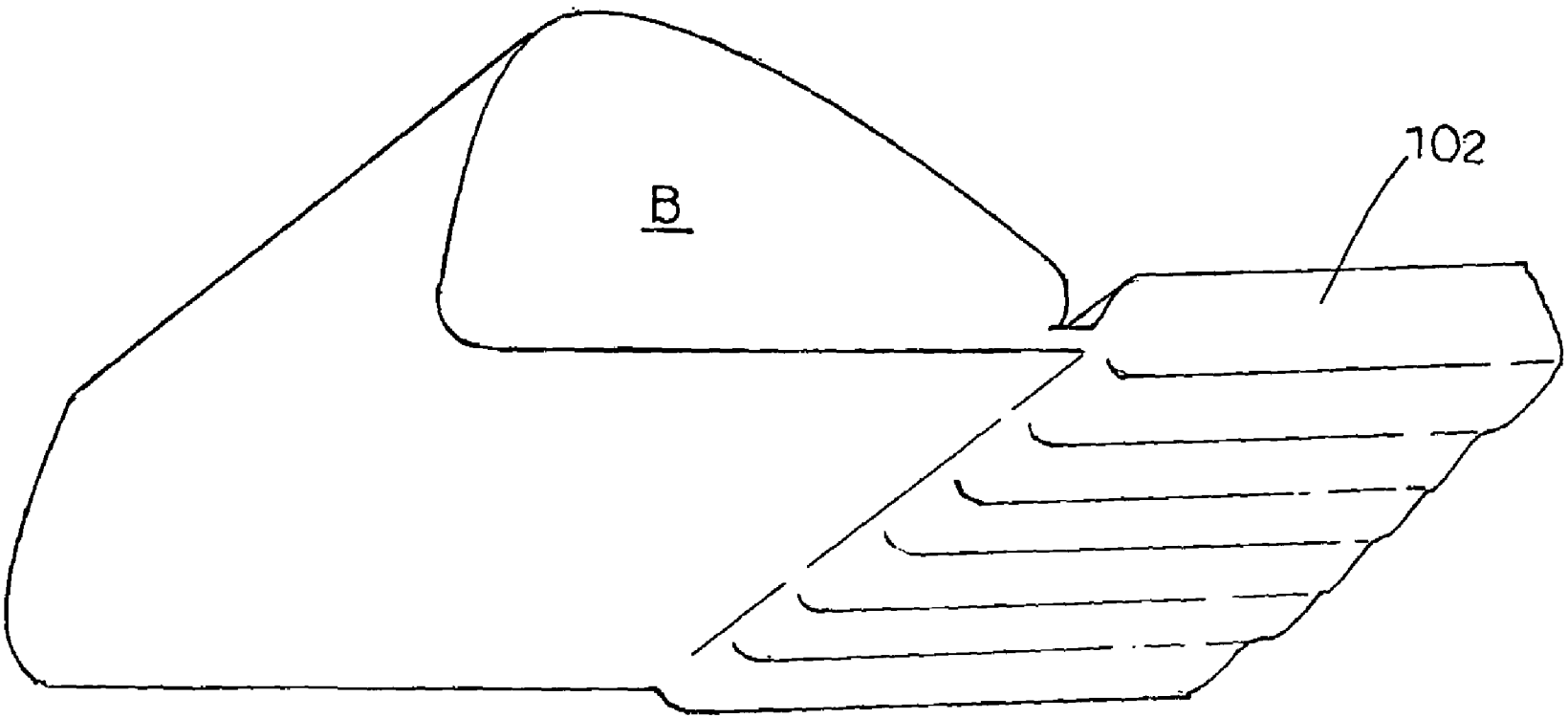
FIG. 10C illustrates a bottom perspective view of a portion of an infant support mat integral with a wedge bolster.
Figure 11A:
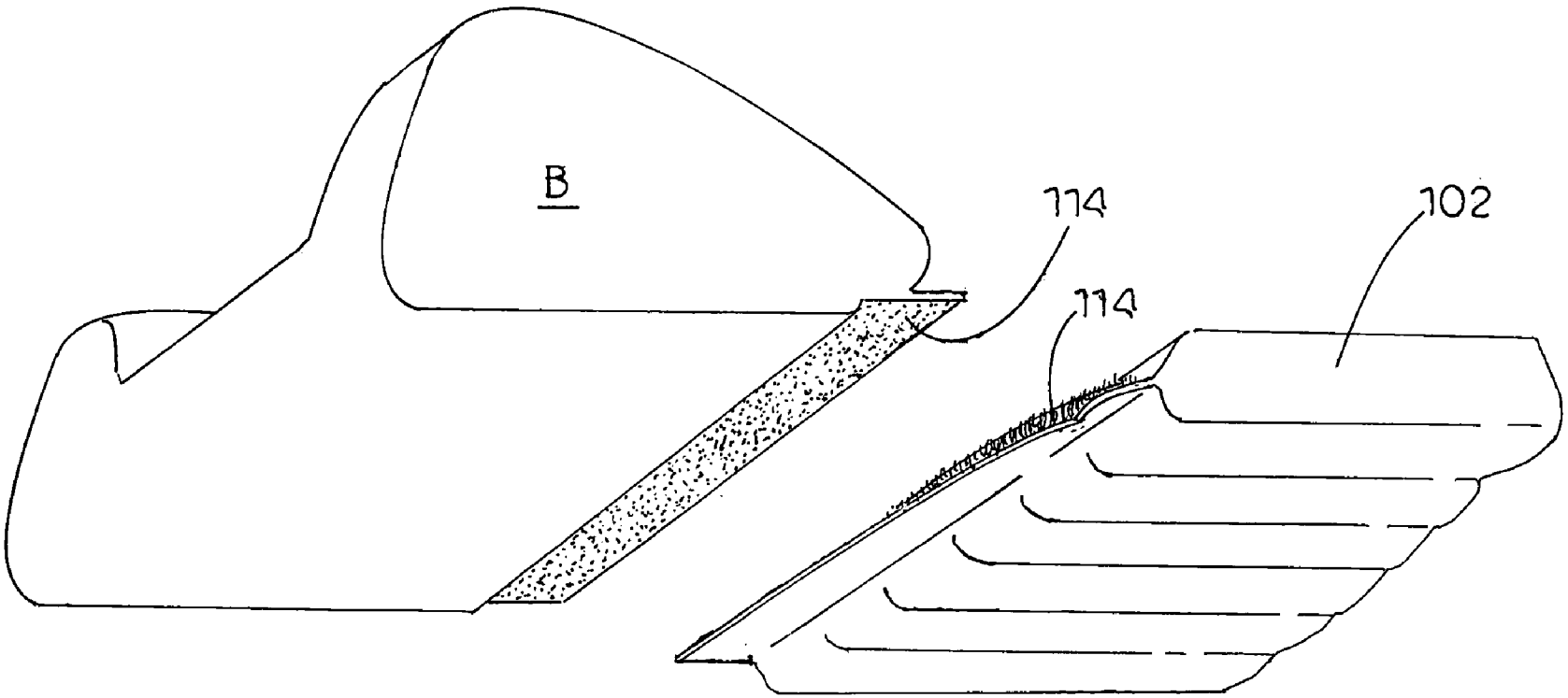
FIG. 11A illustrates a bottom perspective view of a portion of an infant support mat with a modified wedge bolster attachable by hook and loop type fasteners.
Figure 11B:
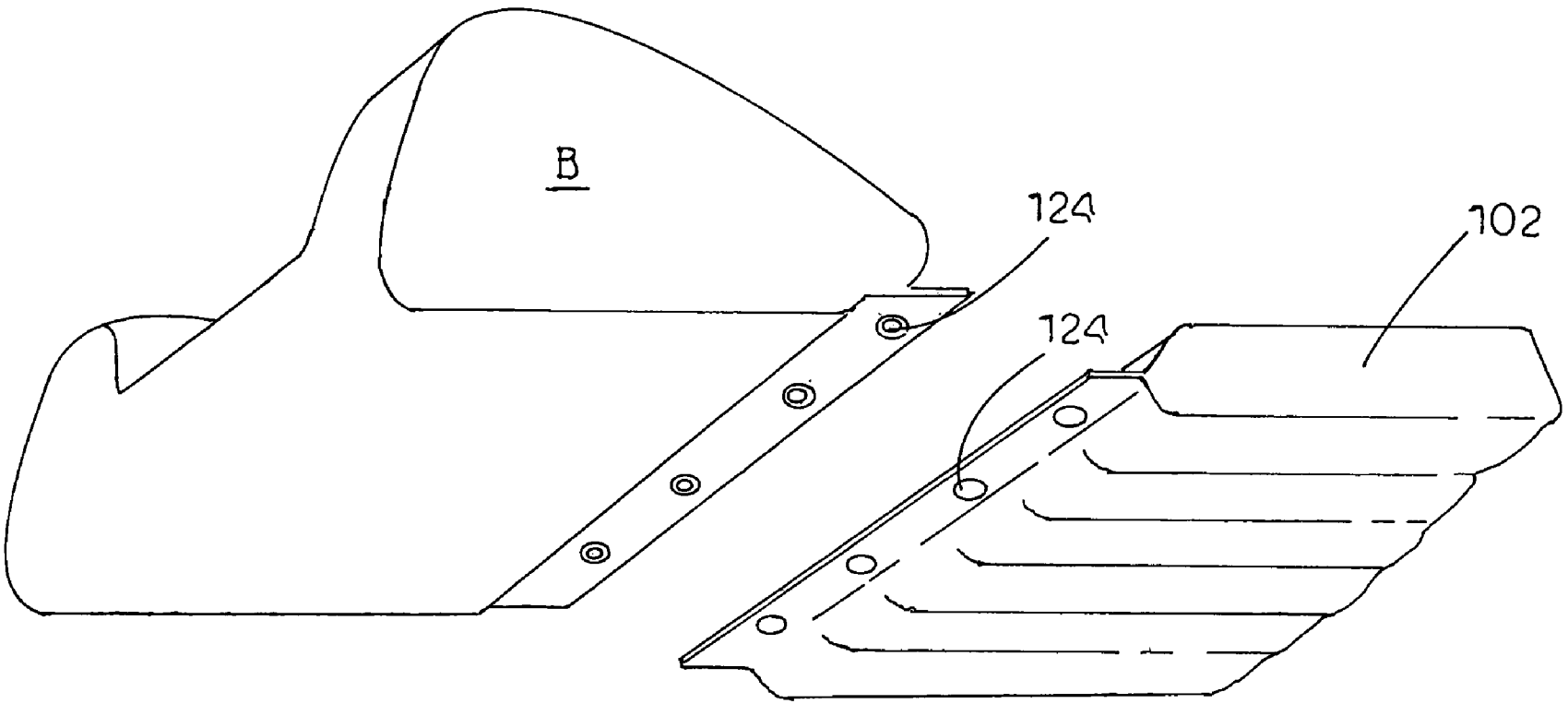
FIG. 11B illustrates a bottom perspective view of a portion of an infant support mat attachable to a modified wedge bolster by snaps.
Figure 11C:
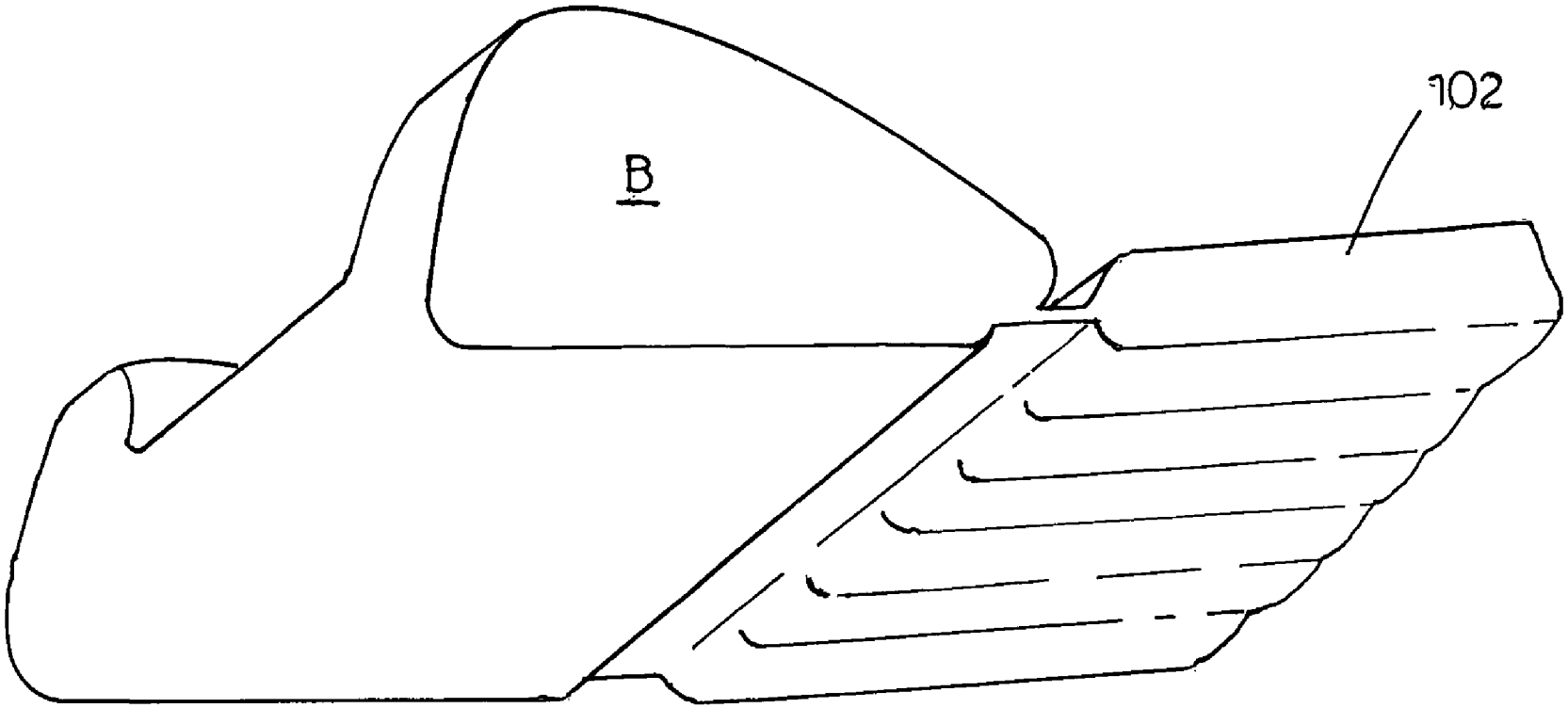
FIG. 11C illustrates a bottom perspective view of a portion of an infant support mat integral with a modified wedge bolster.

FIGS. 9A–9C illustrate bottom perspective views of portions of infant support apparatus 100 showing various fastening mechanisms for attachment of bolster B. FIG. 9A illustrates bolster B attachable to support mat 102 by hook and loop type fasteners 114. Straps or flaps with hook and loop type fasteners 114 attached thereto can be attached to bolster B or support mat 102 to provide for fastening of bolster B to support mat 102. FIG. 9B illustrates bolster B attachable to support mat 102 by snaps 124. Straps or flaps with snaps 124 attached thereto can be attached to bolster B or support mat 102 to provide for fastening of bolster B to support mat 102. FIG. 9C illustrates bolster B integral with support mat 102 and hence permanently affixed. FIGS. 10A–10C and 11A–11C are similar illustrations to FIGS. 9A–9C, but instead with bolster B being wedge-shaped in FIGS. 10A–10C and bolster B being a modified wedge shape with lateral supports projecting therefrom in FIGS. 11A–11C.

Figure 12:
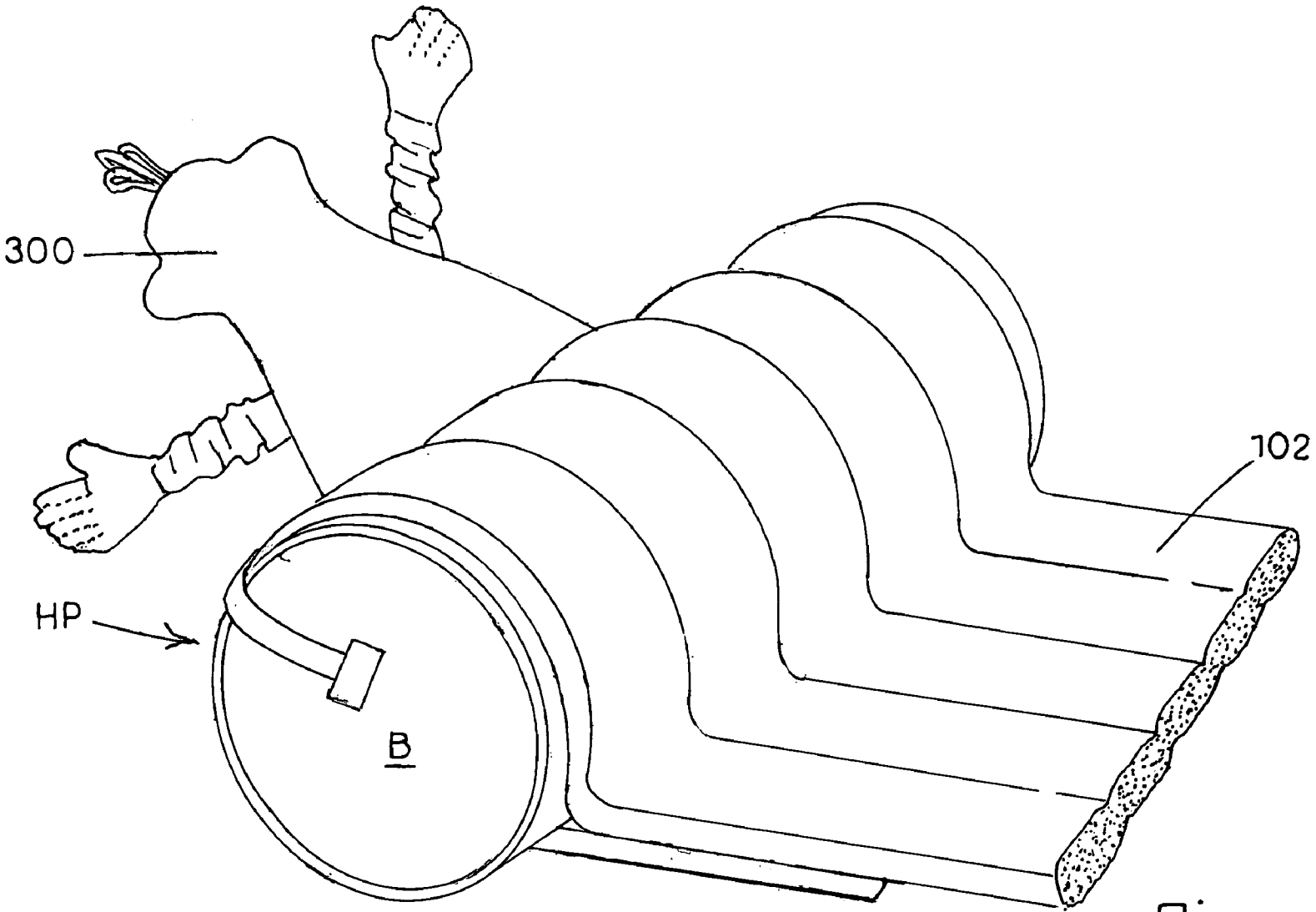
FIG. 12 illustrates a perspective view of a head portion with an infant toy attached thereto.

Furthermore, an infant toy 300 as shown in FIG. 12 can optionally be removably secured to bolster B. It will be appreciated by those of skill in the art that infant toy 300 may be attached to bolster B or support mat 102 by any suitable fastening means. Infant toy 300 can be positioned at head portion HP for use by an infant in a prone position or even at foot portion FP for use by an infant in a supine position.

It will be further understood that various details of the present disclosure may be changed without departing from the scope of the disclosure. Furthermore, the foregoing description is for the purpose of illustration only, and not for the purpose of limitation.

What is claimed is:

1. An infant support apparatus for supporting an infant, the infant support apparatus comprising:

(a) a support mat comprising a bottom surface, and a top surface for supporting an infant and comprising a length with a first end and a second end;

(b) the first end of the support mat comprising a foot portion adapted for engagement with lower extremities of an infant; and (c) a bolster for positioning at least proximate to the second end of the support mat, wherein the second end of the support mat is adapted for overwrapping at least a portion of the bolster to form a head portion for supporting an infant, and wherein the length of the support mat between the foot portion and the bolster is adjustable by adjustment of an amount of overwrapping of the support mat on the bolster.

2. The infant support apparatus of claim 1 wherein the fasteners comprise hook and loop type fasteners.

3. The infant support apparatus of claim 1 wherein the foot portion is an extension of the first end of the support mat.

4. The infant support apparatus of claim 1 wherein the foot portion comprises an at least generally cylindrical cross-sectional shape.

5. The infant support apparatus of claim 1 wherein the bolster comprises an at least generally cylindrical shape.

6. The infant support apparatus of claim 2 wherein a cross-sectional distance of the bolster is greater than a cross-sectional distance of the foot portion.

7. The infant support apparatus of claim 1 wherein the bolster comprises an at least generally wedge shape.

8. The infant support apparatus of claim 4 further comprising at least one lateral support portion positioned on the bolster.

9. The infant support apparatus of claim 1 further comprising at least one lateral support portion positioned on the bolster.

10. The infant support apparatus of claim 1 wherein the bolster the support mat being adapted for overwrapping the bolster such that a distal portion of the support mat extends back toward the foot portion and against another portion of the support mat that is between the foot portion and the bolster, said support mat comprising fasteners located on its bottom surface for maintaining the support mat in an overwrapped position is detached from the support mat.

11. The infant support apparatus of claim 1 wherein the bolster is removably attached to the support mat.

12. The infant support apparatus of claim 8 wherein the bolster is removably attached to the support mat by hook and loop type fasteners.

13. An infant support apparatus for supporting an infant, the infant support apparatus comprising:

(a) an elongated support mat for supporting an infant, the support mat having a length with a top side, a bottom side, a first end, and a second end;

(b) the first end of the support mat extending to form a foot portion adapted for engagement with lower extremities of an infant;

(c) a bolster for positioning against the support mat with the support mat having an intermediate support portion extending between the foot portion and the bolster, a portion of the support mat being adapted for overwrapping around the bolster to form a head portion for supporting an infant wherein at least a portion of the second end of the support mat extends back toward the foot portion and against a portion of the intermediate support portion of the support mat and fastener means located on the bottom side of the support mat for maintaining the second end of the support mat against a portion of the intermediate support portion of the support mat; and (d) wherein the intermediate support portion of the support mat is adjustable by adjustment of an amount of overwrapping of the support mat around the bolster.

* * * * *